US011409208B2

(12) United States Patent
Yoshida et al.

(10) Patent No.: US 11,409,208 B2
(45) Date of Patent: Aug. 9, 2022

(54) IMAGE EXPOSURE HEAD AND IMAGE FORMING APPARATUS

(71) Applicant: CANON KABUSHIKI KAISHA, Tokyo (JP)

(72) Inventors: Hidefumi Yoshida, Abiko (JP); Hayato Koyama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/999,211

(22) Filed: Aug. 21, 2020

(65) Prior Publication Data

US 2021/0055669 A1 Feb. 25, 2021

(30) Foreign Application Priority Data

Aug. 23, 2019 (JP) ..... JP2019-152968

(51) Int. Cl.
*G03G 15/04* (2006.01)
*G03G 15/043* (2006.01)

(52) U.S. Cl.
CPC ..... *G03G 15/043* (2013.01); *G03G 15/04054* (2013.01); *G03G 15/04081* (2013.01); *G03G 2215/0409* (2013.01); *G03G 2215/0412* (2013.01)

(58) Field of Classification Search
CPC ..... G03G 15/04
See application file for complete search history.

(56) References Cited

U.S. PATENT DOCUMENTS

2019/0377279 A1 12/2019 Yoshida ..... G03G 15/043

FOREIGN PATENT DOCUMENTS

JP 2008-246703 A 10/2008

*Primary Examiner* — Walter L Lindsay, Jr.
*Assistant Examiner* — Andrew V Do
(74) *Attorney, Agent, or Firm* — Venable LLP

(57) ABSTRACT

An exposure head for forming an image of a first resolution corresponding to an arrangement interval of a plurality of lower electrodes in a crossing direction or an image of a second resolution lower than the first resolution. A circuit portion includes an image data storage portion that is arranged on the substrate together with a plurality of lower electrodes and converts input image data into image data according to the resolution. By this, the same exposure head can be used for both high resolution images and low resolution images without degrading the image quality.

7 Claims, 20 Drawing Sheets

IMAGE EXPOSURE HEAD AND IMAGE FORMING APPARATUS

FIELD OF THE INVENTION AND RELATED ART

The present invention relates to an exposure head and an image forming apparatus.

In a field of a printer which is an electrophotographic image forming apparatus, a method is generally known in which an exposure head is used to expose a photosensitive drum to form a latent image. Here, for the exposure head, an LED (Light Emitting Diode) or an organic EL (Organic Electro Luminescence), for example is used. The exposure head comprises a light emitting element array extended in the longitudinal direction of the photosensitive drum, and a rod lens array for forming an image of light from the light emitting element array, on the photosensitive drum. It is known that an LED or an organic EL has a surface emitting shape in which the emitting direction of light from the emitting surface is in the same direction as the rod lens array. Here, the length of the light emitting element array is determined depending on a width of an image area on the photosensitive drum, and a distance between the light emitting elements is determined depending on a resolution of the printer. For example, in the case of a 1200 dpi printer, the pixel spacing is 21.16 μm, and therefore the spacing between the light emitting elements also corresponds to 21.16 μm. In a printer that uses such an exposure head, the number of parts used is smaller than that of a laser scanning type printer in which the laser beam is scanned by a laser beam which is deflected by a rotating polygonal mirror, and therefore, it is easy to downsize the device and reduce the cost.

For example, in Japanese Laid-open Patent Application No. 2008-246703, the light emitting elements arranged in the main scanning direction are arranged in a zigzag pattern. When the image resolution is low, only even- or odd-numbered light emitting elements in the main scanning direction are turned on, and when the image resolution is high, all the even and odd numbered light emitting elements are turned on. It is proposed that by this, the light is emitted in accordance with the image resolution.

However, when the number of light emitting elements is changed depending on the resolution of an image as in this example, it is necessary to reduce the number of light emitting elements when the resolution is low and to make the intervals between the light emitting elements that emit light match the resolution. At this time, when the size of the spot formed by each light emitting element on the photosensitive member is smaller than the pixel interval of the image resolution, the spots formed by the adjacent light emitting elements are separated from each other. For this reason, image formation may be performed with the dots separated from each other in the main scanning direction, with the result of a reduction in image quality, such as a jagging on the image edges.

SUMMARY OF THE INVENTION

According to an aspect of the present invention, there is provided an exposure head comprising a plurality of light-emitting devices configured to expose the rotationally driven photosensitive member with light;

Wherein said light emitting device including first substrates, a first electrode layer including a plurality of electrodes which are two-dimensionally arranged in the rotational direction of the photosensitive member and in the rotation axis direction of the photosensitive member, and which are separately formed on each of said first substrate, a light emitting layer which laminated on said first electrode layer and configured to emit light when a voltage is applied, a plurality of light emitting regions including a second electrode layer capable of transmitting light, which is provided on the opposite side opposite to a side on which said first substrates and said first electrode layer are provided with respect to the light emitting layer, in common with the plurality of electrodes of the first electrode layer, and a second substrate on which said first substrates are arranged at positions different from each other in the intersecting direction intersecting the rotational direction, and odd-numbered first substrates and even-numbered first substrates are at different positions in the rotational direction, and are arranged so as to provide an overlapping portion in which respective end portions of the first substrates adjacent to each other overlap each other in the intersecting direction, wherein said driving portion includes a converting portion provided on said first substrate together with said light emitting region and configured to convert received image data into the image data corresponding to the resolution.

Further features of the present invention will become apparent from the following description of exemplary embodiments with reference to the attached drawings.

DESCRIPTION OF THE EMBODIMENTS

In the following, the detailed description of an embodiment of the present invention will be made with reference to the drawings.

Embodiment 1

[Structure of Image Forming Apparatus]

Figure 1:
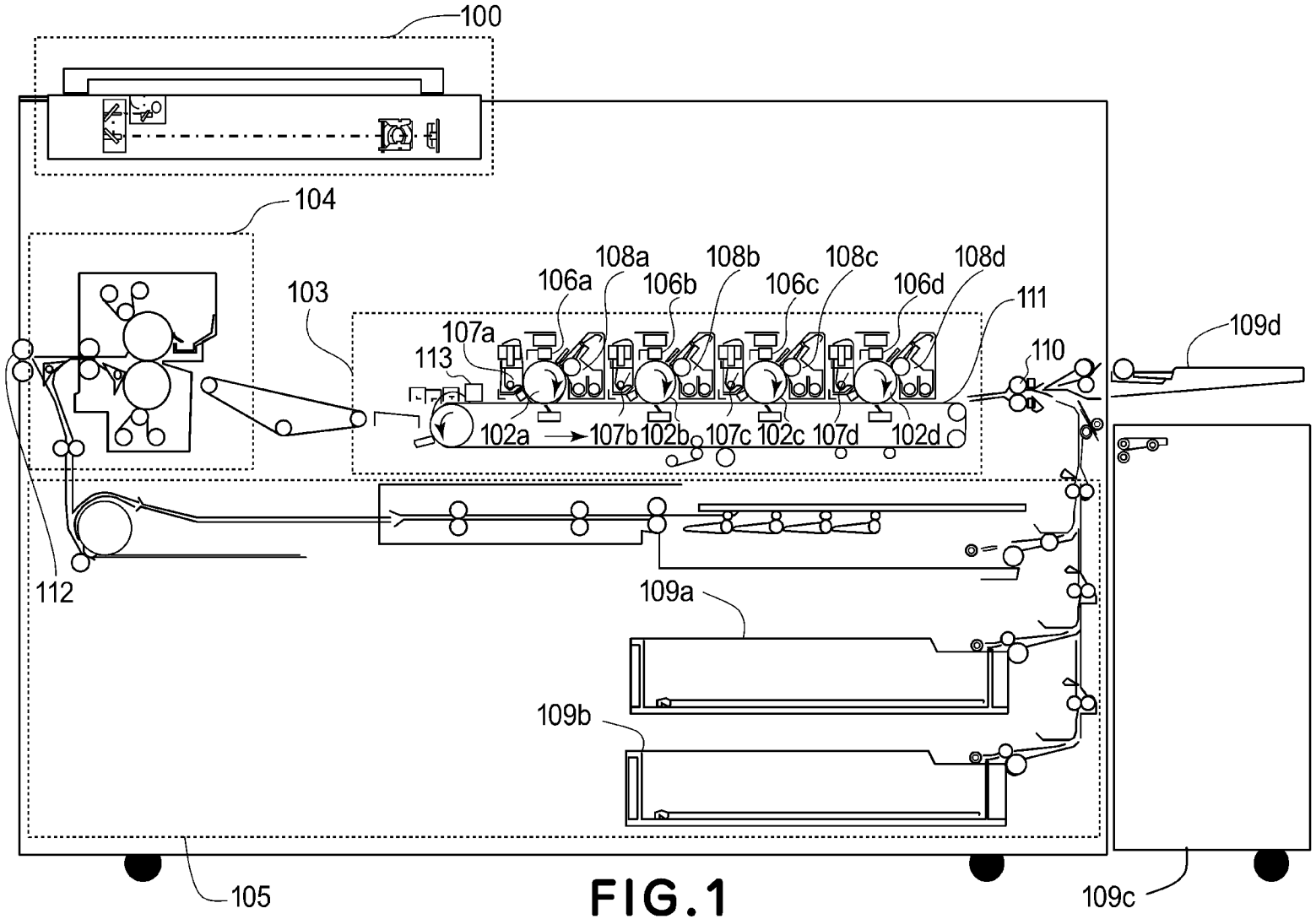
FIG. 1 is a schematic cross-sectional view illustrating the structure of the image forming apparatus according to Embodiments 1 and 2.

FIG. 1 is a schematic cross-sectional view illustrating a structure of an electrophotographic image forming apparatus according to Embodiment 1. The image forming apparatus shown in FIG. 1 is a multi-function machine (multi-function printer: MFP) having a scanner function and a printer function. The image forming apparatus includes a scanner portion 100, an image forming portion 103, a fixing portion 104, a sheet pick-up/feeding portion 105, and a printer control portion (not shown) which controls these portions. The scanner portion 100 illuminates the original placed on the original table, optically reads the original image and converts the read image into an electrical signal to create image data.

The image forming portion 103 is arranged so that: Cyan (C), Magenta (M), Yellow (Y), Black (K4) are arranged in this order. The four image forming stations have the same structure. Each image forming station includes a photosensitive drum 102 rotatable in the direction of the arrow (clockwise direction), the exposure head 106, the charging device 107 and the developing device 108.

The image forming portion 103 is Cyan (C), Magenta (M), Yellow (Y), Black (K4) are arranged in this order.

The image forming portion 103, cyan (C), magenta (M), yellow (Y), black (K) along the rotational direction (counterclockwise direction) of the endless conveyor belt 111. It is provided with four continuous image forming stations arranged in this order.

The image forming portion 103, along with the rotational direction (counterclockwise direction) of the endless conveyor belt 111, is cyan (C), magenta (M), yellow (Y), and black (K) are arranged in this order. The four image forming stations have the same structure. Each image forming station is rotated in the direction of the arrow (clockwise direction). The photosensitive drum. The photosensitive drum 102, the exposure head 106, and the charging device 107. A developing device 108 is provided.

The image forming portion 103 includes four image forming stations arranged in the order of cyan (C), magenta (M), yellow (Y), and black (K) along the rotational direction (counterclockwise direction) of the endless conveyor belt 111. The four image forming stations have the same structure, and each image forming station is provided with a photosensitive drum 102 which is a photosensitive member rotatable in an arrow direction (clockwise direction), an exposure head 106, a charging device 107, and a developing device 108. Here, the subscripts a, b, c and d of the reference numerals of the photosensitive drum 102, the exposure head 106, the charging device 107, and the developing device 108 are for black (K), yellow (Y), magenta (M), and cyan (C) of the image forming stations, respectively. Here, in the following, the subscripts of the reference numerals are omitted unless it refers to a specific photosensitive drum or the like.

In the image forming portion 103, the photosensitive drum 102 is rotationally driven and is charged by the charging device 107. The exposure head 106, which is the exposure means, causes a light emitting device to emit light in accordance with image data, and focuses the light generated by the light emitting device on the photosensitive drum 102 (on the photosensitive member) by a rod lens array to electrostatically form a latent image. The developing device 108, which is a developing unit, develops the electrostatic latent image formed on the photosensitive drum 102 with toner. The developed toner image is transferred onto a recording sheet on a conveyor belt 111 that conveys the recording sheet. A series of such electrophotographic processes are executed at each image forming station. Here, at the time of image formation, after a predetermined time has elapsed since image formation is started at the cyan (C) image forming station, the image forming operations of the magenta (M), yellow (Y), and black (K) image forming stations are executed. By this, a full color image is formed.

The image forming apparatus illustrated in FIG. 1 includes, as units for feeding recording sheet, internal sheet feeding units 109*a* and 109*b* provided in the sheet feeding/feeding unit 105, an external sheet feeding unit 109*c* which is a large-capacity sheet feeding unit, and a manual sheet feeding unit 109*d*. During image formation, the recording sheet is fed from a sheet feed unit selected in advance, and the recording sheet is fed to the registration roller 110. The registration roller 110 feeds the recording sheet to the feeding belt 111 at the timing when the toner image formed in the image forming portion 103 described above is to be transferred onto the recording sheet. The toner images formed on the photosensitive drums 102 of each image forming stations are sequentially transferred onto the recording sheet fed by the conveyor belt 111. The recording sheet onto which the unfixed toner image is transferred is fed to the fixing portion 104. The fixing portion 104 has a heat source such as an inside halogen heater, and fixes the toner image on the recording sheet by heating and pressing with using rollers. The recording sheet on which the toner image has been fixed by the fixing portion 104 is discharged to the outside of the image forming apparatus by discharge rollers 112.

An optical sensor 113 as a detection mean is provided at a position facing the conveyor belt 111 on the downstream side, in the recording sheet conveyance direction, of the black (K) image forming station. The optical sensor 113 determines the color misregistration amount of the toner images between the image forming stations, and to do this, the positions of the test images formed on the conveyor belt 111 is detected. The color misregistration amount acquired by the optical sensor 113 is notified to the image controller portion 700 (FIG. 6) which will be described hereinafter, and the image position of each color is adjusted so that a full-color toner image without color misregistration is transferred onto the recording sheet is transferred. In addition, the printer control portion (not shown) is responsive to an instruction from the MFP control portion (not shown) which controls the entire multifunction peripheral (MFP), and the scanner portion 100, the image forming portion 103, the fixing portion 104, and the sheet feeding/feeding portion 105 described above to execute the image forming operation.

Here, as an example of the electrophotographic image forming apparatus, the image forming apparatus of the type in which the toner image formed on the photosensitive drum 102 of each image forming station is directly transferred onto the recording sheet carried on the conveyor belt 111 has been described. The present invention is not limited to such a printer which directly transfers the toner image on the photosensitive drum 102 onto recording sheet. For example, the present invention is applicable also to an image forming apparatus including a primary transfer portion which transfers the toner image on the photosensitive drum 102 to the intermediary transfer belt and a secondary transfer portion which transfers the toner image on the intermediary transfer belt to the recording sheet.

[Structure of Exposure Head]

Figure 2:
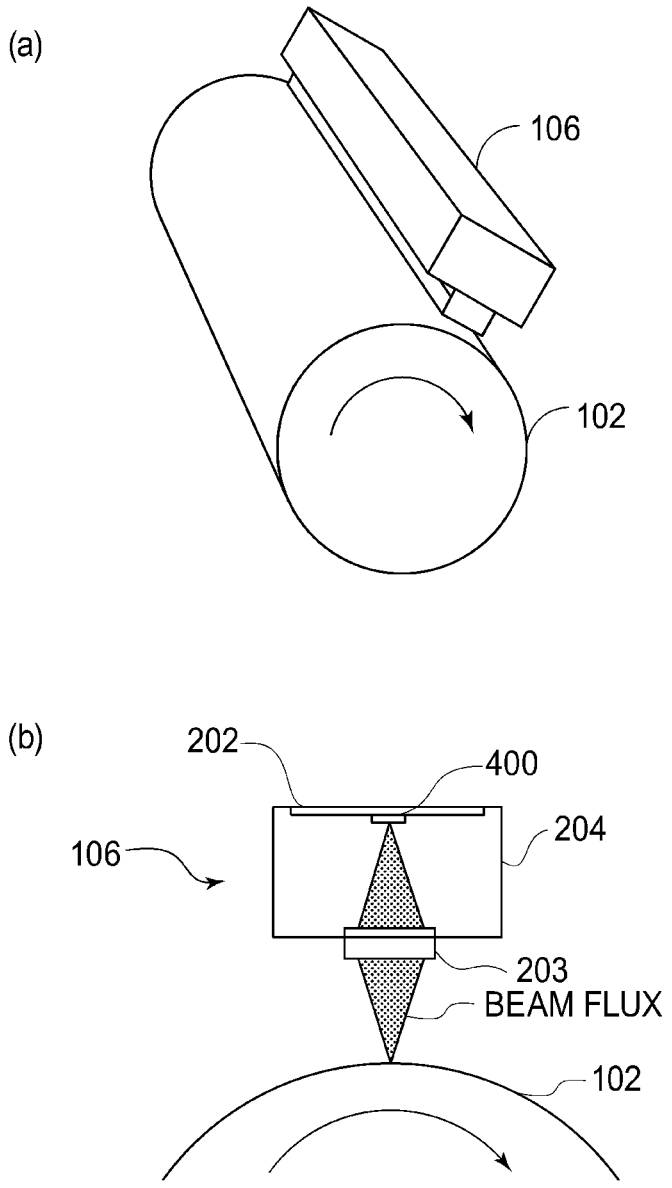
FIG. 2 is an illustration showing a structure of an exposure head of Embodiments 1 and 2.

Referring to FIG. 2, the description will be made as to the exposure head 106 which exposes the photosensitive drum 102 to the image light. Part (a) of FIG. 2 is a perspective view illustrating the positional relationship between the exposure head 106 and the photosensitive drum 102, and part (b) of FIG. 2 illustrates an internal structure of the exposure head 106 and how a light flux from the exposure head 106 is condensed on a photosensitive drum 102 by a rod lens array 203. As shown in part (a) of FIG. 2, the exposure head 106 is mounted to the image forming apparatus by a mounting member (not shown) at a position facing the photosensitive drum 102 above the photosensitive drum 102 which rotates in the arrow direction (FIG. 1).

As shown in part (b) of FIG. 2, the exposure head 106 includes a printed circuit board 202, a light emitting device group 400 mounted on the printed circuit board 202, a rod lens array 203, and a casing 204. The rod lens array 203 and the printed circuit board 202 are mounted to the casing 204. As shown in FIG. 2, the rod lens array 203 is disposed between the light emitting device group 400 and the photosensitive drum 102. The rod lens array 203 is extended along the longitudinal direction of the printed circuit board 202, and is effective to focus the luminous flux emitted from each of the light emitting device groups 400, on the photosensitive drum 102. In the factory, the exposure head 106 is assembled and adjusted, and the focusing and light intensity are adjusted. Here, assembly and adjustment are performed so that the distance between the photosensitive drum 102 and the rod lens array 203 and the distance between the rod lens array 203 and the light emitting device group 400 are at predetermined intervals. By this, the light from the light emitting device group 400 is imaged on the photosensitive drum 102. Therefore, during focus adjustment in the factory, the mounting position of the rod lens array 203 is adjusted so that the distance between the rod lens array 203 and the light emitting device group 400 is a predetermined value. In addition, at the time of adjusting the light amount in the factory, the lower electrode of the light emitting device 401, which will be described hereinafter, is driven so that the light condensed on the photosensitive drum 102 via the rod lens array 203 has a predetermined light amount by adjusting the voltage applied.

[Structure of Light Emitting Device Group]

Figure 3:
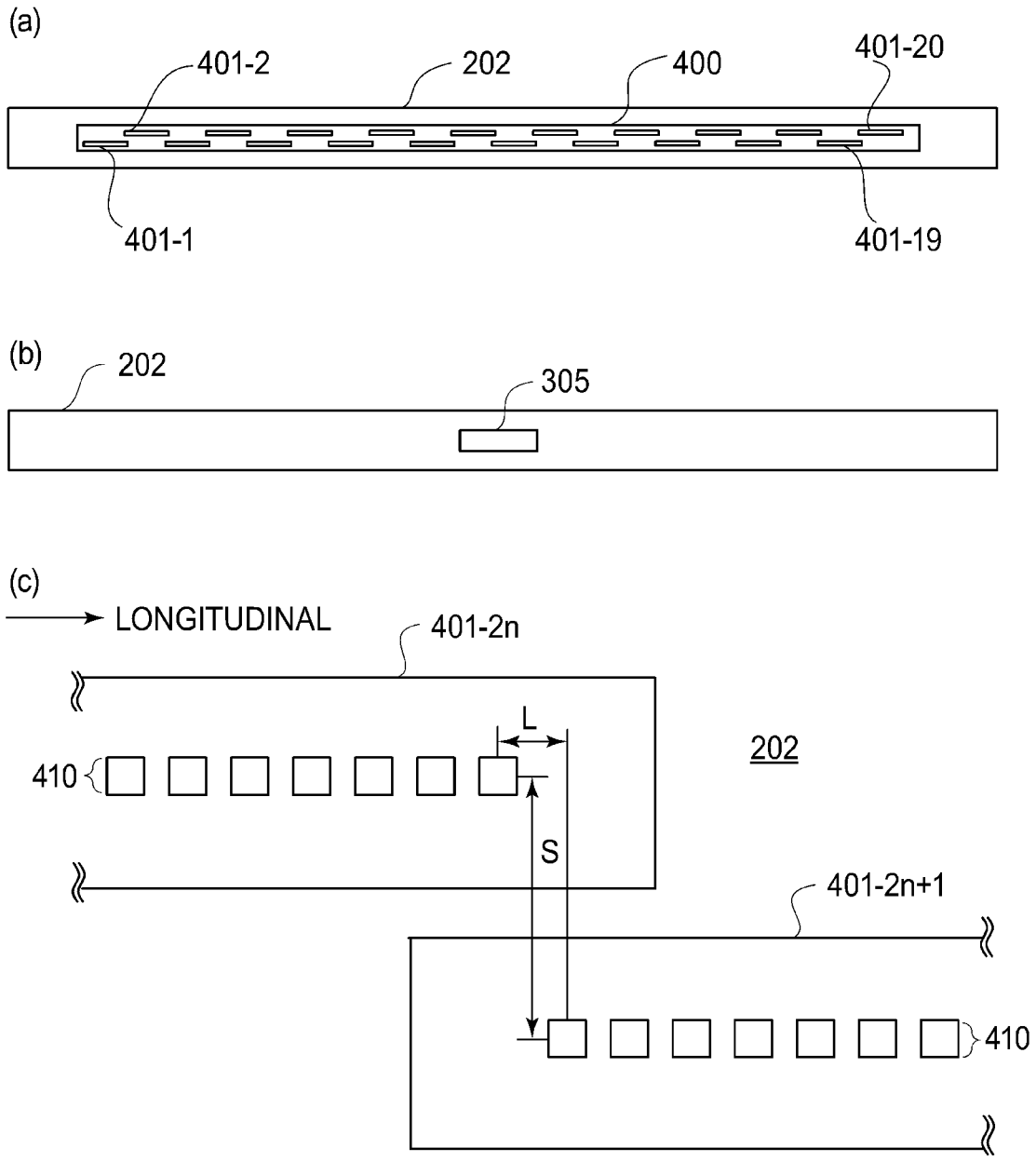
FIG. 3 shows the structure of a printed circuit board in Embodiment 1.

FIG. 3 is an illustration of the printed circuit board 202 and the light emitting device group 400 mounted on the printed circuit board 202. Part (a) of FIG. 3 is a schematic illustration showing the structure of the surface of the printed circuit board 202 on which the light emitting device group 400 is mounted, and part (b) of FIG. 3 is a schematic illustration showing a structure of a surface (second surface) opposite to the surface on which the light emitting device group 400 of the printed circuit board 202 is mounted (first surface).

As shown in part (a) of FIG. 3, the light emitting device group 400 mounted on the printed circuit board 202, which is the second substrate, includes 20 independent light emitting devices 401-1 to 401-20, which are arranged in two rows so as to be staggered along the longitudinal direction of the printed circuit board 202. That is, on the printed circuit board 202 (on the second board), the odd-numbered light emitting devices 401-1 (401-2*n*+1:n≥0) and the even-numbered light emitting devices 401-2 (401-2*n*:n≥1) are arranged at different positions in the rotational direction of the photosensitive drum 102. The light emitting devices 401-1 to 401-20 are sometimes collectively referred to as light emitting device 401. Here, in part (a) of FIG. 3, the up-down direction indicates the rotational direction of the photosensitive drum 102 which is the first direction, and the horizontal direction indicates the longitudinal direction which is the second direction perpendicular to the first direction. The longitudinal direction is also a crossing direction that crosses the rotating direction of the photosensitive drum 102. Each light emitting device 401 has therein a total of 748 lower electrodes which will be described hereinafter. In this embodiment, one lower electrode is placed at each 21.16 μm (ne 2.54 cm/1200 dots) As a result, the arrangement distance from the end to the end of the 748 lower electrodes in one light emitting device 401 is about 15.8 mm (ne 21.16 μm×748). The light emitting device group 400 comprises 20 light emitting devices 401. The number of lower electrodes that can be exposed in the light-emitting device group 400 is 14, 960 (=748 electrodes×20 chips), and the light-emitting device group 400 is capable of illuminating the area corresponding an image width (in a lengthwise direction of the light-emitting device group) of about 316 mm (ne 15.8 mm×20 chips).

In addition, as shown in part (b) of FIG. 3, a connector 305 is mounted on the surface of the printed circuit board 202 opposite to the surface on which the light emitting device group 400 is mounted. The connector 305 is for connecting a control signal and a power line for controlling the light emitting device group 400 from an image controller portion 700 (FIG. 6) which will be described hereinafter, and each of the light emitting devices 401-1 to 401-20 is driven by way of the connector 305.

Part (c) of FIG. 3 is an illustration showing a state of a boundary portion between chips of the light emitting device 401 arranged in two rows in the longitudinal direction, and the horizontal direction is the longitudinal direction of the light emitting device group of part (a) of FIG. 3, along which the light emitting devices 401 are arranged. Part (c) of FIG. 3 shows the boundary between the chips of the light emitting device 401 (the portion where the ends of the chips overlap with each other in the longitudinal direction (overlap portion). Also at the boundary between the light emitting device 401-2*n* and the light emitting device 401-2*n*+1, the longitudinal pitch (the interval between the center points of the two adjacent lower electrodes (L)) of the lower electrodes 410 at the ends between the different light emitting devices 401 is about 21.16 μm, which is the pitch for the resolution of 1200 dpi.

In addition, the light emitting devices 401 arranged in the upper and lower two rows in the lateral direction are arranged as follows. That is, the upper and lower light emitting devices 401 are arranged such that a space between the upper and lower electrodes (arrow S in the Figure) which will be described hereinafter is about 105 m (5 pixels at 1200 dpi). In addition, the interval between the light emitting points in the longitudinal direction of the exposure head 106 (indicated by arrow L in the Figure) is about 21.16 m (one pixel at 1200 dpi). Here, in the present invention, the intervals S and L between the light emitting devices 401 are not limited to the values described above.

[Structure of Light Emitting Device]

Figure 4:
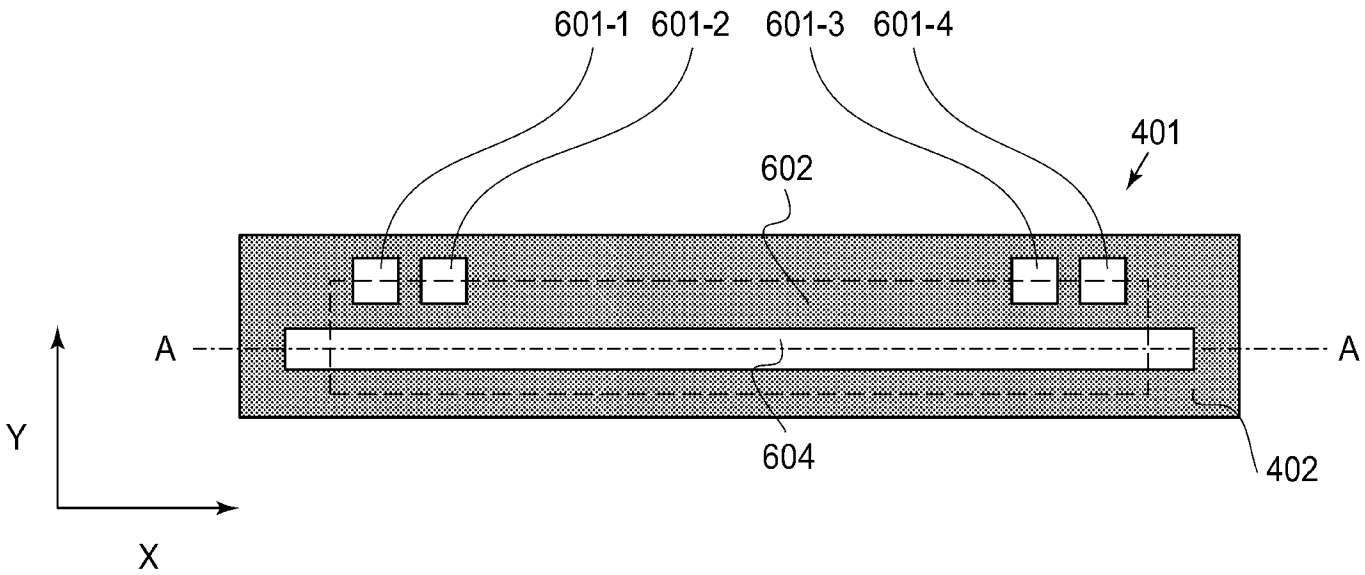
FIG. 4 is an illustration showing a structure of a silicon substrate in Embodiments 1 and 2.

FIG. 4 is a schematic illustration showing an internal structure of the light emitting device 401. Here, as shown in FIG. 4, the longitudinal direction of the light emitting device 401 is the X direction and the lateral direction is the Y direction. Here, the Y direction is the rotational direction of the photosensitive drum 102, and in other words, the moving direction of the photosensitive surface (photosensitive member surface) of the rotatable photosensitive drum 102. The X direction is a direction substantially perpendicular to the Y direction which is the rotational direction of the photosensitive drum 102. In addition, it is also a direction substantially parallel to the rotation axis direction of the photosensitive drum 102. Here, "substantially perpendicular" means to cover an angle of 90°±1°, and substantially parallel covers the case of an inclination of ±1°. That is, the longitudinal direction of the light emitting device 401 may be inclined about ±1° with respect to the rotation axis direction of the photosensitive drum 102. In addition, the lateral direction of the light emitting device 401 may also be inclined about ±1° with respect to the rotational direction of the photosensitive drum 102. The light emitting device 401 includes a first substrate which is a silicon substrate 402, and wire bonding pads (hereinafter referred to as WB pads) 601-1, 601-2, 6013, 601-4, thereon. Here, a circuit portion 602 (broken line), which is a drive section, is built in the silicon substrate 402. As the circuit portion 602, a structure including an analog drive circuit or a digital control circuit can be used. The power supply to the circuit portion 602 and input/output of signals from outside the light emitting device 401 are performed by way of the WB pad 601.

The light emitting device 401 of this embodiment includes a line-shaped light emitting region 604 extending along the rotation axis direction of the photosensitive drum 102. The light emitting region 604 is a region which includes anodes, cathodes, and light emitting layers 450 (FIG. 5) which will be described hereinafter, and emits light when potential differences are generated between the anodes and the cathodes.

A silicon (Si) substrate can be preferably used for the substrate 402. This is because of the following advantages. That is, for the silicon substrates, the process technology for forming integrated circuits has been developed and is already used as a substrate for various integrated circuits, and therefore, high-speed and highly functional circuits can be advantageously produced at high density. In addition, with respect to silicon substrates, large-diameter wafers are available on the market, which is advantageous because of inexpensive availability.

In Embodiment 1, the circuit portion 602 is provided with a driving portion for driving the light emitting region 604, a data transfer/light-emitting-signal-generating-portion for generating data for generating a signal for causing the light emitting region 604 to emit light (hereinafter, referred to as a light emitting signal), and the circuit portion 602 is formed on the silicon substrate 402. By doing so, the high speed response circuit can be produced.

[Structure of Light Emitting Area]

Figure 5:
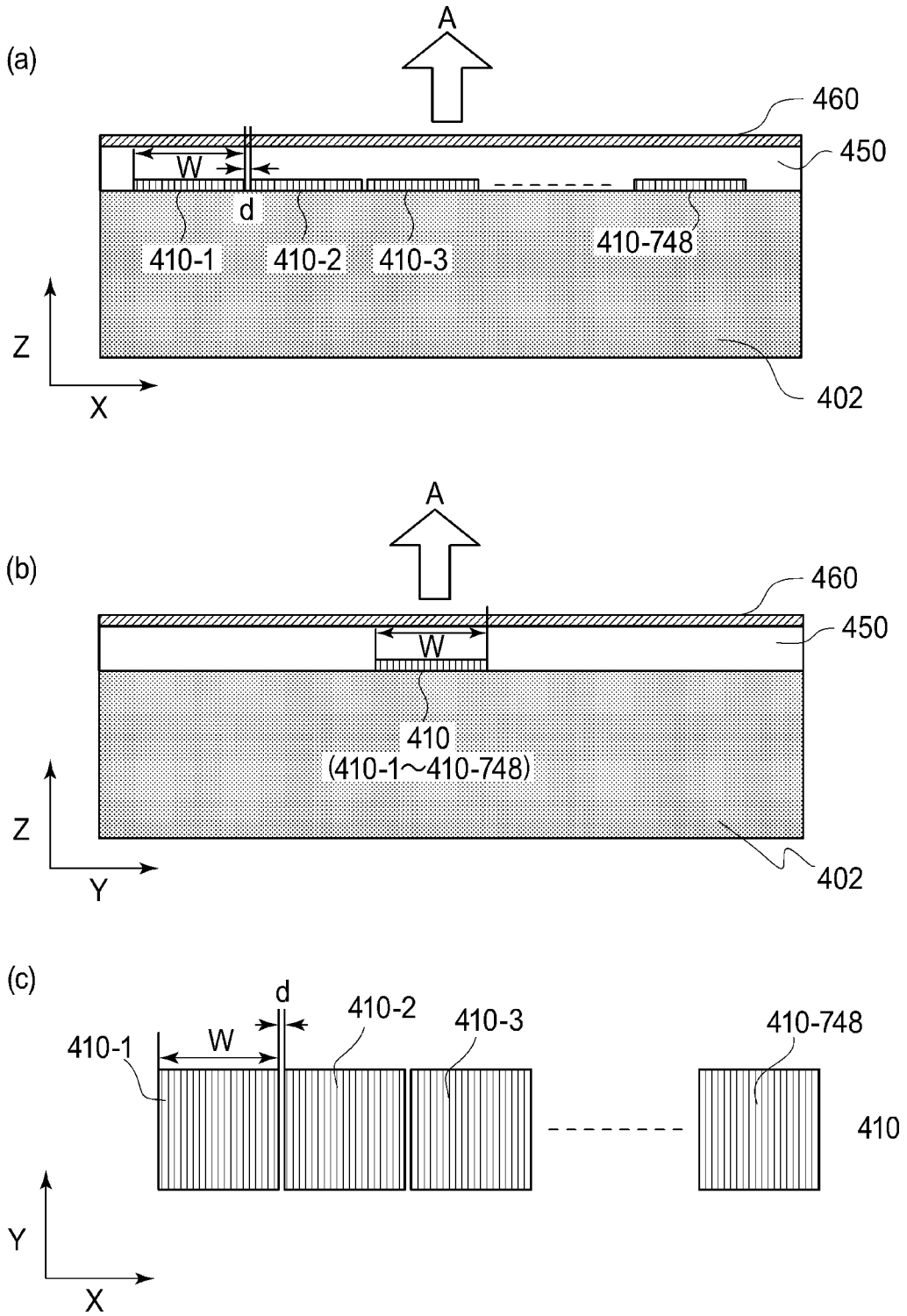
FIG. 5 is a cross-sectional view of a light emitting area of Embodiment 1, and an illustration of the light emitting device.

Referring to FIG. 5, the light emitting device 401 will be described in more detail. The X direction in FIG. 5 indicates the longitudinal direction of the exposure head 106. A Z direction is the direction in which the layers of the layer structure described below overlap (laminating direction). Part (a) of FIG. 5 is an enlarged view of the major parts of the schematic illustration of a cross-section taken along a line A-A in FIG. 4. Part (a) of FIG. 5 is a schematic view of lower electrodes 410-1 to 410-748, which will be described hereinafter, as viewed in the Y direction. As shown in part (a) of FIG. 5 and part (c) of FIG. 5, the light emitting device 401 includes the silicon substrate 402, the lower electrodes 410-1 to 410-748, the light emitting layer 450, and the upper electrode 460. The silicon substrate 402 is a drive substrate on which drive circuits including driving portions corresponding to the lower electrodes 410-1 to 410-748, which will be described hereinafter, are formed in the manufacturing process.

As shown in part (a) of FIG. 5 and part (c) of FIG. 5, the lower electrodes 410-1 to 410-748 (cathode) are formed in layers (first electrode layer) on the silicon substrate 402. The lower electrodes 410-1 to 410-748 are formed on driving portions built in the silicon substrate 402 using Si integrated circuit processing technology together with the manufacturing process for the silicon substrate 402. The lower electrodes 410-1 to 410-748 are preferably made of a metal including a high reflectance with respect to the emission wavelength of the light emitting layer 450 which will be described hereinafter. Therefore, it is preferable that the lower electrodes 410-1 to 410-748 contain silver (Ag), aluminum (Al), or alloys of them, silver, magnesium alloys, and so on.

As shown in FIG. 5, the lower electrodes 410-1 to 410-748 are provided corresponding to respective pixels in the X direction. That is, each lower electrodes 410-1 to 410-748 are provided to form one pixel. The lower electrodes 410-1 to 410-748 are the first electrode row. Here, these lower electrodes 410-1 to 410-748 may be arranged at an angle of about ±1° with respect to the direction of the rotation axis of the photosensitive drum 102. It is not necessary that the photosensitive drums 102 are arranged strictly in parallel to the rotation axis direction.

The width W of the lower electrodes 410-1 to 410-748 in the X direction in this embodiment corresponds to the width of one pixel. The interval d is the distance between the lower electrodes (arrangement interval) in the X direction. The lower electrodes 410-1 to 410-748 are formed on the silicon substrate 402 with a space d, and therefore, the driving portions formed on the silicon substrate 402 can individually control the voltages of the lower electrodes 410-1 to 410-748. The space d is filled with an organic material of the light emitting layer 450, and the lower electrode is partitioned by the organic material.

In the light emitting device 401 according to this embodiment, the width W of the lower electrodes 410-1 to 410-748 is 20.90 μm as a nominal dimension, and the interval d is 0.26 μm as a nominal dimension. That is, the light emitting device 401 of this embodiment is provided with one lower electrode 410 for every 21.16 μm in the X direction. The dimension 21.16 μm is the size of 1 pixel at 1200 dpi, and therefore, the width of each lower electrode 410 in the X direction has a size corresponding to one pixel corresponding to the output resolution of the image forming apparatus of this embodiment. Here, the process and rule in the light emitting device 401 of this embodiment are highly accurate, that is, about 0.2 μm, and it is possible to form the width of d with a resolution of 0.26 μm.

In addition, as shown in part (b) of FIG. 5, the width of the lower electrodes 410-1 to 410-748 in the Y direction which is the rotational direction of the photosensitive drum 102, is also W. That is, the lower electrodes 410-1 to 410-748 of this embodiment have a square shape of 20.90 μm, and the area of the lower electrode 410 is 436.81 μm^2. This occupies approx. 97.6% of one pixel area of 447.7456 μm^2. Organic light emitting materials have less light intensity than an LED. On the contrary, as described above, the lower electrode 410 is formed in a square shape and the distance between the adjacent lower electrodes is made small to form it on the silicon substrate 402. It becomes possible to assure the light emitting area to provide an enough light intensity to change the potential on the photosensitive drum 102. Here, it is preferable to secure a lower electrode area of 90% or more of the occupied area of one pixel. Therefore, for an image forming apparatus with an output resolution of 1200 dpi, it is preferable that the width of one side of the lower electrode 410 is formed to be about 20.07 μm or more, and, for an image forming apparatus with an output resolution of 2400 dpi, it is preferable that one side of the lower electrode 410 is formed with a width of about 10.04 μm or more.

On the other hand, the upper limit of the occupied area of the lower electrode 410 should be selected based on the transmittance of the rod lens array 203 and the upper electrode 460 which will be described hereinafter, but in this embodiment, 110% is selected as the upper limit with respect to the occupied area of one pixel. If it is larger than 110% of the area occupied by one pixel, the size of the pixel formed when exposing the photosensitive drum 102 with high sensitivity may significantly exceed the resolution, and therefore, the upper limit of the occupied area of the lower electrode 410 is set to 110%. Therefore, for an image forming apparatus having an output resolution of 1200 dpi, it is preferable that one side of the lower electrode 410 is formed to have a width of about 22.19 μm or less, and for an image forming apparatus having an output resolution of 2400 dpi, it is preferable that the width of one side of the lower electrode 410 is about 11.10 μm or less. That is, it is preferable that the range of the occupied area of the lower electrode 410 to the occupied area of one pixel is 90% or more and 110% or less.

Here, the shape of the lower electrode 410 is not limited to a square, and it can be a polygonal shape higher than square, circular shape, elliptical shape, or the like may be used, if it emits light of an exposure area size corresponding to the output resolution of the image forming apparatus, and if the light is enough to provide the image quality of the output image of a level which meets the design specifications of the image forming apparatus.

Next, the light emitting layer 450 will be described. The light emitting layer 450 is formed by laminating on the silicon substrate 402 on which the lower electrodes 410-1 to 410-748 are formed. That is, in the portions where the lower electrodes 410-1 to 410-748 are formed, the light emitting layer 450 is laminated on the lower electrodes 410-1 to 410-748. In a portion where they are not formed, the lower electrodes 410-1 to 410-748 are laminated on the silicon substrate 402. In this embodiment, in the light emitting device 401, the light emitting layer 450 is formed so as to extend over all of the lower electrodes 410-1 to 410-748, but such an example is not inevitable to the present invention. For example, similarly to the lower electrodes 410-1 to 410-748, the light emitting layer 450 may be formed so as to be separately laminated on each lower electrode, or the lower electrodes 410-1 to 410-748 may be divided into a plurality of groups, and then, for each of the divided groups, one light emitting layer may be laminated on the lower electrode belonging to the group.

For the light emitting layer 450, an organic material, for example may be used. The light emitting layer 450, which is of an organic EL film, has a laminated structure including functional layers such as an electron transport layer, a hole transport layer, an electron injection layer, a hole injection layer, an electron block layer, and a hole block layer. For the light emitting layer 450, an inorganic material other than an organic material may be used.

The upper electrode 460 (anode) is laminated on the light emitting layer 450 (second electrode layer). The upper electrode 460 is the electrode capable of transmitting (transmitting) light having an emission wavelength of the light emitting layer 450. Therefore, the upper electrode 460 of this embodiment employs a material containing indium tin oxide (ITO) as a transparent electrode. The indium tin oxide electrode has a transmittance of 80% or more for the light in the visible light range, and therefore, it is suitable as an electrode for organic EL.

The upper electrode 460 is formed on the opposite side of the lower electrodes 410-1 to 410-748 with at least the light emitting layer 450 interposed therebetween. That is, the light emitting layer 450 is arranged between the upper electrode 460 and the lower electrodes 410-1 to 410-748 in the Z direction, and as the lower electrodes 410-1 to 410-748 are projected on the upper electrode 460 in the Z direction, the area where the lower electrodes 410-1 to 410-748 are formed is within the area where the upper electrode 460 is formed. Here, the transparent electrode does not have to be laminated over the entire light emitting layer 450, but in order to efficiently emit the light generated in the light emitting layer 450 to the outside of the light emitting device 401, it is preferable that the area occupied by the upper electrode 460 is 100% or more with respect to the area occupied by one pixel, and more preferably it is 120% or more. The upper limit of the area occupied by the upper electrode 460 is arbitrarily designed depending on the areas of the silicon substrate 402 and the light emitting layer 450. Wiring may be provided in the upper electrode 460 except for the portion which transmits light.

The upper electrode 460 of this embodiment is an anode commonly provided for each of the lower electrodes 410-1 to 410-748, but the lower electrodes 410-1 to 410-748 may be individually provided, or one upper electrode may be provided for each of the plurality of lower electrodes.

The drive circuit controls the electric potential of the lower electrodes 410-1 to 410-748 in order to generate a potential difference between a potential difference between the upper electrode 460 and one of the lower electrodes 410-1 to 410-748 on the basis of the image data.

The light emitting device 401 in this embodiment is a so-called top emission type emission type device. When voltages are applied to the upper electrode 460 which is the anode, and to the lower electrode 410 which is the cathode, to produce a potential difference between them, the electrons flow from the cathode to the light emitting layer 450, and the holes flow from the anode to the light emitting layer 450. And, the light emitting layer 450 emits the light by recombination of electrons and holes in the light emitting layer 450. The light emitted toward the upper electrode 460 when the light emitting layer 450 emits light passes through the upper electrode 460 and is emitted from the light emitting device 401 in the direction of arrow A shown in FIG. 5. In addition, the light traveling from the light emitting layer 450 toward the lower electrode 410 is reflected by the lower electrode 410 toward the upper electrode 460, and the reflected light also passes through the upper electrode 460 and is emitted from the light emitting device 401. There is a time difference between the light emitted from the light emitting layer 450 toward the upper electrode 460 and the light reflected by the lower electrode 410 and emitted from the upper electrode 460, in the emitting timing from the upper electrode 460, but, the layer thickness of the light emitting device 401 is extremely small, and therefore, the emission timings can be regarded as almost the same.

By using a transparent electrode such as indium tin oxide as the upper electrode 460, the aperture ratio indicating the light transmission ratio of the electrode can be made substantially equal to the transmittance of the upper electrode 460. That is, there is virtually no portion that attenuates or blocks light except the upper electrode 460, and therefore, the light emitted from the light emitting layer 450 is emitted substantially without being attenuated or blocked.

In addition, as described above, the lower electrodes 410-1 to 410-748 can be arranged at a high density by forming the lower electrodes 410-1 to 410-748 using a highly accurate Si integrated circuit processing technique. Therefore, almost all of the area of the light emitting region 604 (here, the total of the areas of the lower electrodes 410-1 to 410-748 and the area between the adjacent lower electrodes) can be assigned to the lower electrodes 410-1 to 410-748. That is, the exposure head has a high utilization efficiency of the light emitting region per unit area.

Here, in the case that a light-emitting material such as an organic EL layer or an inorganic EL layer that is weak against moisture is used as the light-emitting layer 450, it is preferable that a sealing is provided in order to prevent moisture from entering the light-emitting region 604. As a sealing method, for example, a single or laminated film of silicon oxide, silicon nitride, aluminum oxide, or the like is formed. The method for forming the sealing film is preferably a method providing excellent coating performance for the structures such as steps, and an atomic layer deposition method (ALD method), for example can be used. Here, the material, structure, forming method of the sealing film are examples, and the present invention is not limited to the above examples, and a suitable one may be appropriately selected.

[Control Block]

Figure 6:
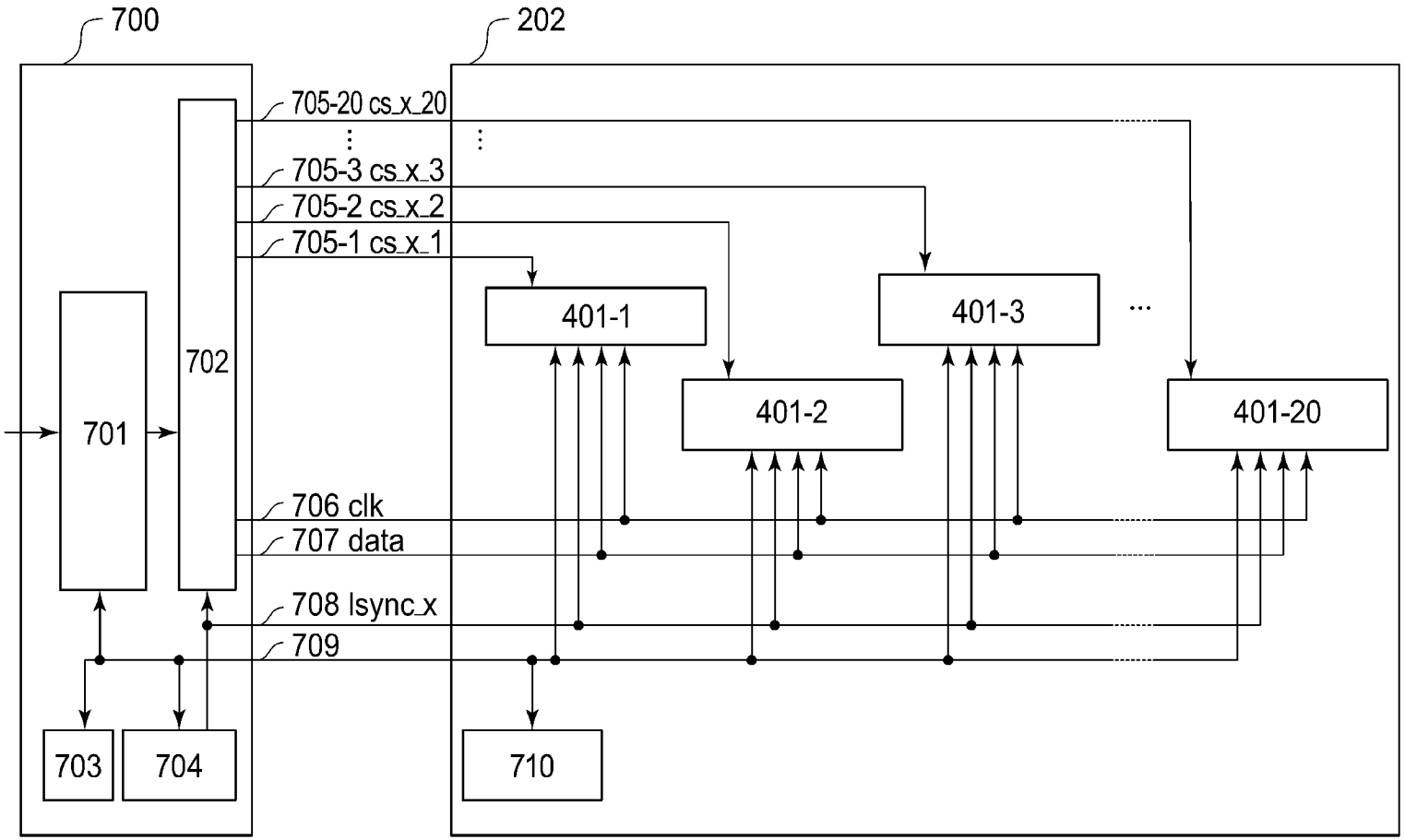
FIG. 6 is a block diagram of an image controller and the printed circuit board of Embodiments 1 and 2.

FIG. 6 shows a block diagram of the image controller portion 700 and the printed circuit board 202. In the following, the chip select signal is cs_x, the line synchronization signal is lsync_x, the clock signal is clk, and the image data signal is data. Here, the chip select signal cs_x is outputted corresponding to each light emitting device 401. More specifically, the chip select signal cs_x_1 is outputted to the light emitting device 401-1, and the chip select signal cs_x_2 is outputted to the light emitting device 401-2. The chip select signal cs_s_20 is outputted to the light emitting device 401-20. In Embodiment 1, processing of a single color will be described for simplification of an explanation, but, similar processing operations are performed in parallel for the four colors.

(Image Controller Portion)

The image data generated by the scanner portion 100 is inputted to the image controller portion 700, and a control signal for controlling the printed circuit board 202 is transmitted. Here, the image data input to the image controller portion 700 may be the data generated by the scanner portion 100 as described above, or may be the data transferred from a personal computer by way of a network device (not shown). The control signals include a chip select signal cs_x indicating the effective range of the image data, a clock signal clk, an image data signal data, a line synchronization signal lsync_x indicating the division of the image data for each line, and a communication signal for communication with the CPU 703. Each signal is transmitted to the light emitting device 401 in the printed circuit board 202 by way of the chip select signal line 705, the clock signal line 706, the image data signal line 707, the line synchronization signal line 708, and the communication signal line 709. Here, the chip select signal lines 705 are specifically the chip select signal lines 705-1 to 705-20. The image controller portion 700 performs processing for image data and processing for print timing. The image data generating portion 701 performs dithering processing on the image data received from the scanner portion 100 or the outside of the image forming apparatus at the resolution designated by the CPU 703 to generate image data for print output. In Embodiment 1, for example, the apparatus is operable in a low resolution mode which is the second mode in which the dithering process is performed at the resolution of 600 dpi which is the second resolution, and in a high resolution which is the first mode in which the dithering process is performed at the resolution of 1200 dpi.

The synchronization signal generating portion 704 generates a line synchronization signal lsync_x which is a second signal and outputs it by way of the line synchronization signal line 708. The CPU 703 instructs the synchronization signal generating portion 704 about the time interval of the signal cycle as one line cycle for a predetermined rotation speed and resolution of the photosensitive drum 102. Here, the one-line cycle is a cycle in which the surface of the photosensitive drum 102 moves in the rotational direction by a pixel size corresponding to the resolution. In the rotational direction of the surface of the photosensitive drum 102, in the low resolution mode, the CPU 703 instructs the synchronization signal generating portion 70 of the time interval of the signal period on the basis of one line cycle corresponding to the period of movement by the pixel size (about 42.32 μm) in 600 dpi. For example, when printing is performed at a speed of 200 mm/s in the feeding direction of the recording sheet, the CPU 703 instructs the synchronization signal generating portion 704 of the time interval of 211.6 μs (two decimal places or less omitted). In addition, in the high resolution mode, the CPU 703 instructs the synchronization signal generating portion 704 on the time interval of the signal cycle, with the cycle of moving the pixel size corresponding to 1200 dpi (about 21.16 μm) as one line cycle. For example, when printing is performed at a speed of 200 mm/s in the recording sheet feeding direction, the CPU 703 instructs the time interval with one line cycle being 105.8 μs (two decimal places or less omitted). The speed in the feed direction is calculated by the CPU 703 using the set value (fixed value) of the printing speed (image forming speed) set in the control portion (not shown) which controls the speed of the photosensitive drum 102. Here, the printing speed is set according to the type of recording sheet, for example.

The chip data converting portion 702 divides the image data for one line into each light emitting device 401 in synchronization with the line synchronization signal lsync_x generated by the synchronization signal generating portion 704. The chip data converting portion 702 transmits the image data divided for each light emitting device 401 to the printed circuit board 202 together with the clock signal clk and the chip select signal cs_x. The clock signal clk is a signal which serves as a control reference.

(Printed Board)

Next, the structure of the printed board 202 will be described. The head information storage portion 710 is a storage device which stores head information such as the amount of light emitted from each light emitting device 401 and mounting position information, and is connected to the CPU 703 by way of the communication signal line 709 which transmits the communication signal. The clock signal line 706, the image data signal line 707, the line synchronization signal line 708, and the communication signal line 709 are all connected to the light emitting device 401. The chip select signal line 705 includes chip select signal lines 705-1 to 705-20 for each light emitting device 401 and is connected to each light emitting device 401-1 to 401-20. Each light emitting device 401 drives the lower electrode 410 based on the set values set by the chip select signal cs_x, the clock signal clk, the line synchronization signal lsync_x, the image data signal data, and the communication signal.

(Data Transfer from Image Controller to Printed Circuit Board)

Figure 7:
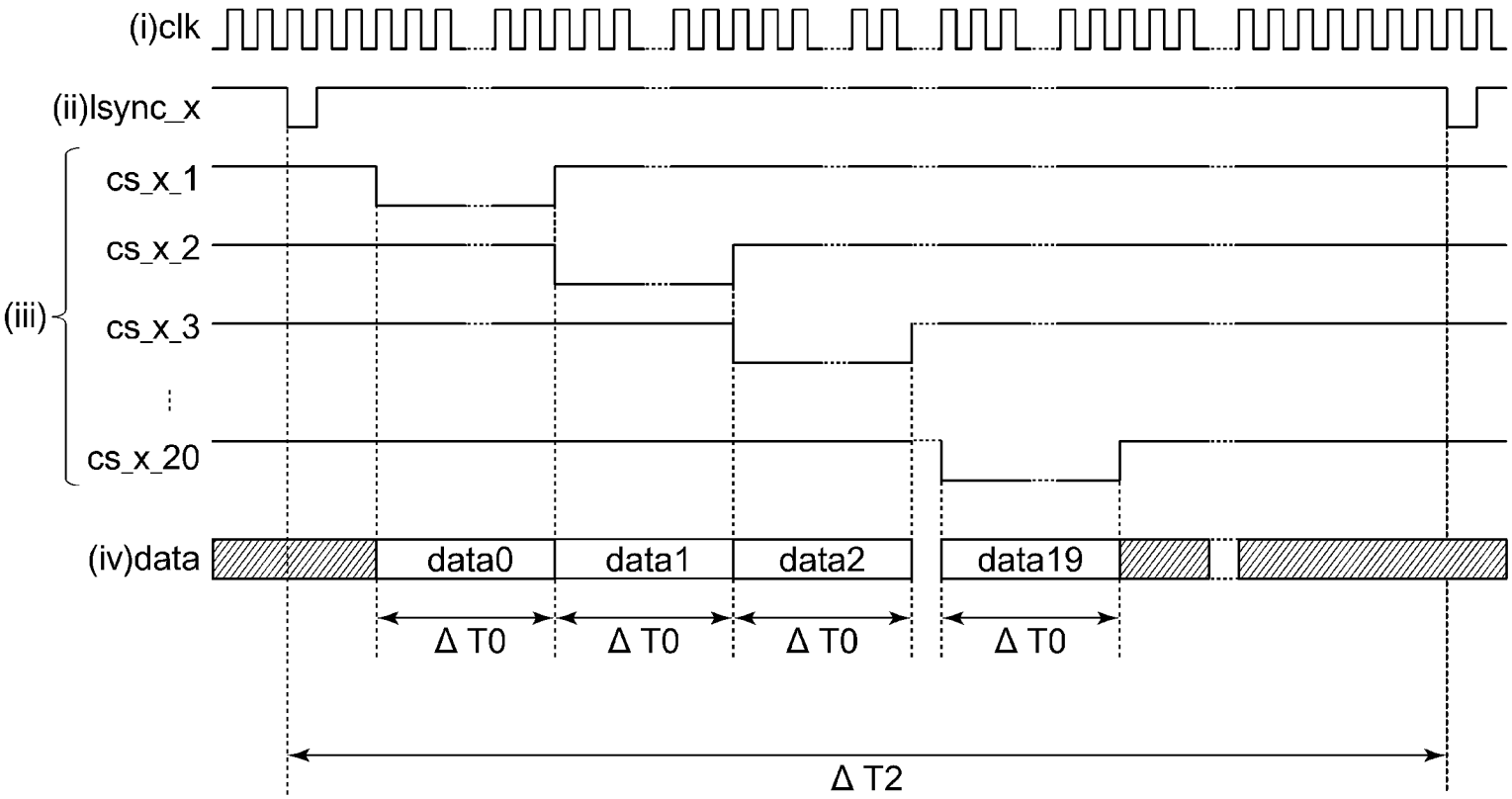
FIG. 7 is a timing chart illustrating data transfer in Embodiment 1.

Here, the data transfer from the image controller portion 700 to the light emitting device 401 mounted on the printed circuit board 202 will be described. FIG. 7 is an illustration showing signals connected between the image controller portion 700 and the light emitting device 401 of the printed circuit board 202. In FIG. 7, (i) shows the waveform of the clock signal clk, and (ii) shows the waveform of the line synchronization signal lsync_x. Part (iii) shows the waveforms of the chip select signals cs_x_1 to cs_x_20, and (iv) shows the image data signals data (data0 to data19). The shaded area of the image data signal data indicates data which is invalid as image data. Here, the chip select signal cs_x_1 or the like indicates the chip select signal input to the light emitting device 401-1 or the like by way of the chip select signal line 705-1 or the like. In addition, the image data for driving the lower electrode 410 in the n-th light emitting device 401-*n* is represented by data (n−1). For example, the image data for driving the lower substrate in the first light emitting device 401-1 is data0. Therefore, data0 to data19 form one line of image data. In addition, as the image data signal data, the image data for one pixel of the image is transferred in one cycle of the clock signal clk. The amount of image data for one line depends on the resolution mode. For example, in the high resolution mode, one line has 14960 pixels of image data, and in the low resolution mode, one line has half the image data, that is, 7480 pixels.

Depicted by ΔT0 in FIG. 7 indicates the time required to transmit the image data signal data to the light emitting device 401-1 or the like. That is, the time ΔT0 is 748 (=14960/20) times the one cycle of the clock signal clk, in the high resolution mode. On the other hand, in the low resolution mode, the time is 374 (=7480/20) times the one cycle of the clock signal clk. The chip select signals cs_x_1 to cs_x_20 input to each of the light emitting devices 401-1 to 401-20 become sequentially valid (asserted). By this, the image data data0 to data19 and the light emitting devices 401-1 to 401-19 can be associated (synchronized). As described above, the time ΔT2 which is one cycle of the line synchronization signal lsync_x is 105.8 μs in the high resolution mode and 211.6 μs in the low resolution mode. One cycle of the clock signal clk is set to the same cycle as time ΔT2 when multiplied by an integer, but it is sufficient that all the image data data0 to data19 can be transferred onto the light emitting device 401 within one cycle of the line synchronization signal lsync_x.

[Circuit Structure in Light Emitting Device]

Figure 8A:
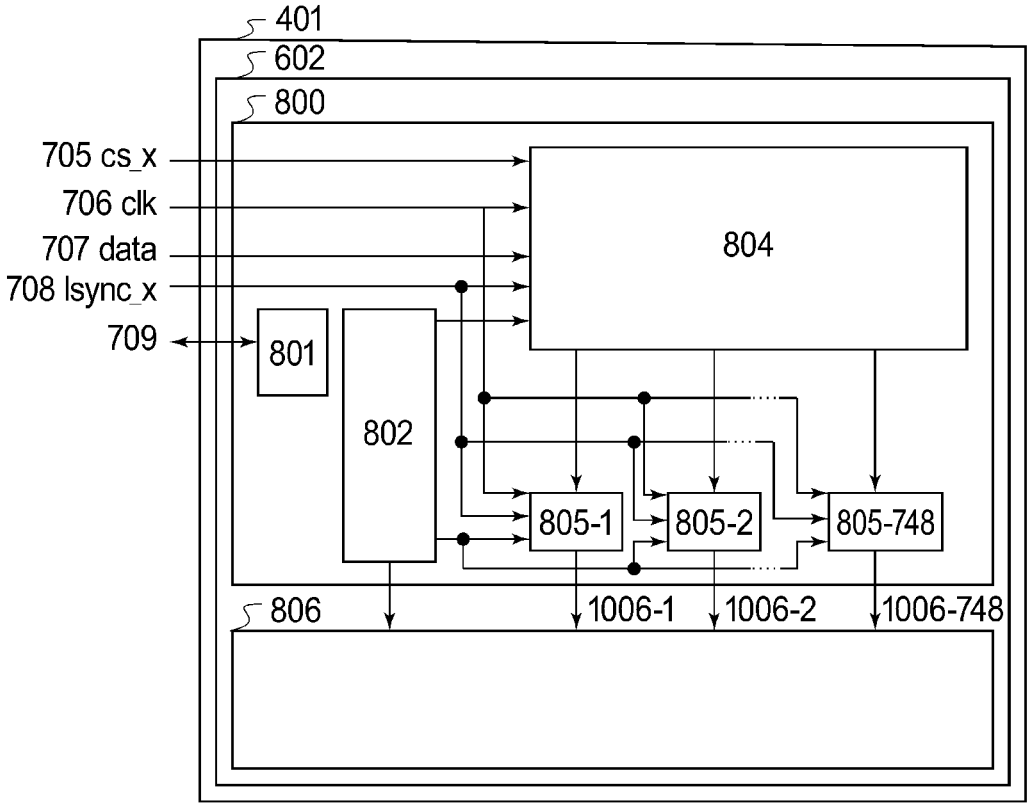
FIG. 8A and FIG. 8B are a circuit illustration of the light emitting device in Embodiment 1.

FIG. 8A is a circuit block diagram in the light emitting device 401. The circuit portion 602 in the light emitting device 401 has a digital portion 800 and an analog portion 806. The digital portion 800 has a function of generation a pulse signal for driving the lower electrode 410-*n* based on the set value preset by the communication signal and various signals in synchronization with the clock signal clk, and sending, them through the pulse signal line 1006, to the analog portion 806. Here, the various signals refer to the chip select signal cs_x, the image data signal data, and the line synchronization signal lsync_x.

[Digital Part]

The communication IF portion 801 controls writing and reading of the set value for the register portion 802 based on a communication signal from the CPU 703. The register portion 802 stores the set value necessary for the operation (set value preset in advance). This set value includes set information of the exposure timing information usable with the image data storage portion 804, the width and phase information (delay information) of the pulse signal generated by the pulse signal generating portion 805, and the drive voltage set by the analog portion 806. Here, the drive voltage can be derived from the resistance value between the lower electrode and the upper electrode, and the range of this resistance value is determined in advance, and therefore, information about the drive current may be stored instead of the drive voltage setting information. The image data storage portion 804 holds the image data during the period in which the inputted chip select signal cs_x is valid, and outputs the image data to the pulse signal generating portion 805 in synchronization with the line synchronization signal lsync_x. Details will be described hereinafter.

The pulse signal generating portion 805 generates a pulse signal on the basis of the pulse signal width information and phase information (delay information) set in the register portion 802 in accordance with the image data inputted from the image data storage portion 804, and transmits it to the analog portion 806. Details will be described hereinafter. The analog portion 806 generates a signal required to drive the lower electrode 410 on the basis of the pulse signal generated by the digital portion 800. Details will be described hereinafter.

(Image Data Storage Portion)

Figure 8B:
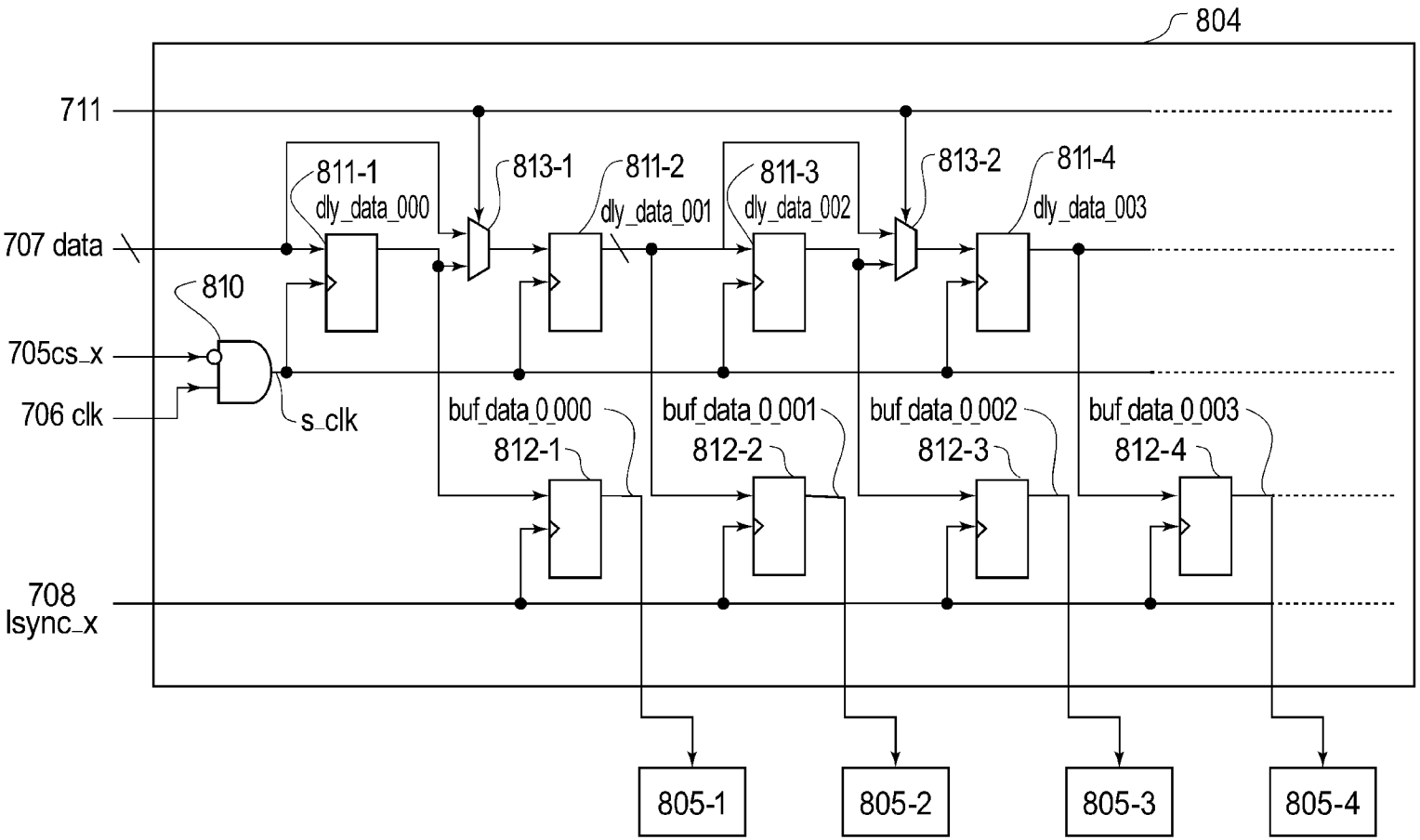

Next, the operation of the image data storage portion 804 will be described. The image data storage portion 804 of Embodiment 1 is built in the light emitting device 401. The image data storage portion 804 functions as a converting portion which converts the image data into image data in accordance with the resolution, as will be described hereinafter. FIG. 8B is a circuit structure illustration of the image data storage portion 804. The chip select signal cs_x and line synchronization signal lsync_x are negative logic signals in this example, but they may be positive logic signals. Furthermore, the resolution mode signal connected to the register portion 802 by way of the resolution mode signal line 711 corresponds to the low resolution mode (600 dpi) when it is "0", and corresponds to the high resolution mode (1200 dpi) when it is "1" The resolution mode signal is a register signal set in accordance with the operation of the image data generating portion 701. The clock gate circuit 810 outputs the logical product of the inverted signal of the chip select signal cs_x and the clock signal clk. The clock gate circuit 810 outputs the clock signal s_clk to the flip-flop circuit 811 only when the chip select signal cs_x is valid.

The flip-flop circuit 811 receives the image data signal data inputted to the image data storage portion 804, as an original input. The same number of flip-flop circuits 811 as the lower electrodes 410 provided in the longitudinal direction of the light emitting device 401 (748 in Embodiment 1) are connected in series. The entire flip-flop circuit 811 functions as a shift circuit. More specifically, the flip-flop circuit 811 comprises flip-flop circuits 81-1-1, 811-2, 811-748. Here, selectors 813-1, 813-2 . . . are connected to the preceding stage of the data input terminal D of the even-numbered flip-flop circuits 811 such as the flip-flop circuits 81-2 and 811-4. The selectors 813-1 and so on are collectively called selector 813. The resolution mode signal line 711 is connected to the selector 813 as a select signal, and the resolution mode signal is inputted thereto.

When the resolution mode signal is "1", the selector 813 outputs the output of the flip-flop circuit 811 connected to the front stage of the selector 813 to the flip-flop circuit 811 connected to the rear stage of the selector 813. When the resolution mode signal is "0", the selector 813 outputs the input of the flip-flop circuit 811 connected to the front stage of the selector 813 to the flip-flop circuit 811 connected to the rear stage of the selector 813. Specifically, the selector 813-1 will be explained. When the resolution mode signal is "1", the selector 813-2 outputs the output (dly_data_002) of the flip-flop circuit 811-3 in the front stage of the selector 813-2 to the flip-flop circuit 811-4 in the rear stage of the selector 813-2. When the resolution mode signal is "0", the selector 813 outputs the input (dly_data_001) of the flip-flop circuit 811-3 in the front stage of the selector 813-2 to the flip-flop circuit 811-4 in the rear stage of the selector 813-2.

The flip-flop circuit 811 operates in accordance with the clock signal s_clk fed from the clock gate circuit 810. The output of the flip-flop circuit 811 is outputted as image data dly_data_000 to dly_data_747 to the next adjacent flip-flop circuit 811 or the selector 813 and the flip-flop circuit 812. The number of the flip-flop circuits 811 and 812 are provided correspondingly to the number of the lower electrodes 410 (748 in Embodiment 1) in the longitudinal direction of the lower electrodes 410.

The flip-flop circuit 812 receives the output of the flip-flop circuit 811 as an input, and operates in accordance with the line synchronization signal lsync_x. The flip-flop circuit 812 includes flip-flop circuits 812-1, 812-2 and 812-748. The output of the flip-flop circuit 812 is outputted to the pulse signal generating portions 805-1 to 805-748 as the image data buf_data_0_000 to buf_data_0_747. Here, one cycle of the line synchronization signal lsync_x is 105.8 μs (decimal 2 digits or less omitted) in the high resolution mode.

(In High Resolution Mode)

Figure 9A:
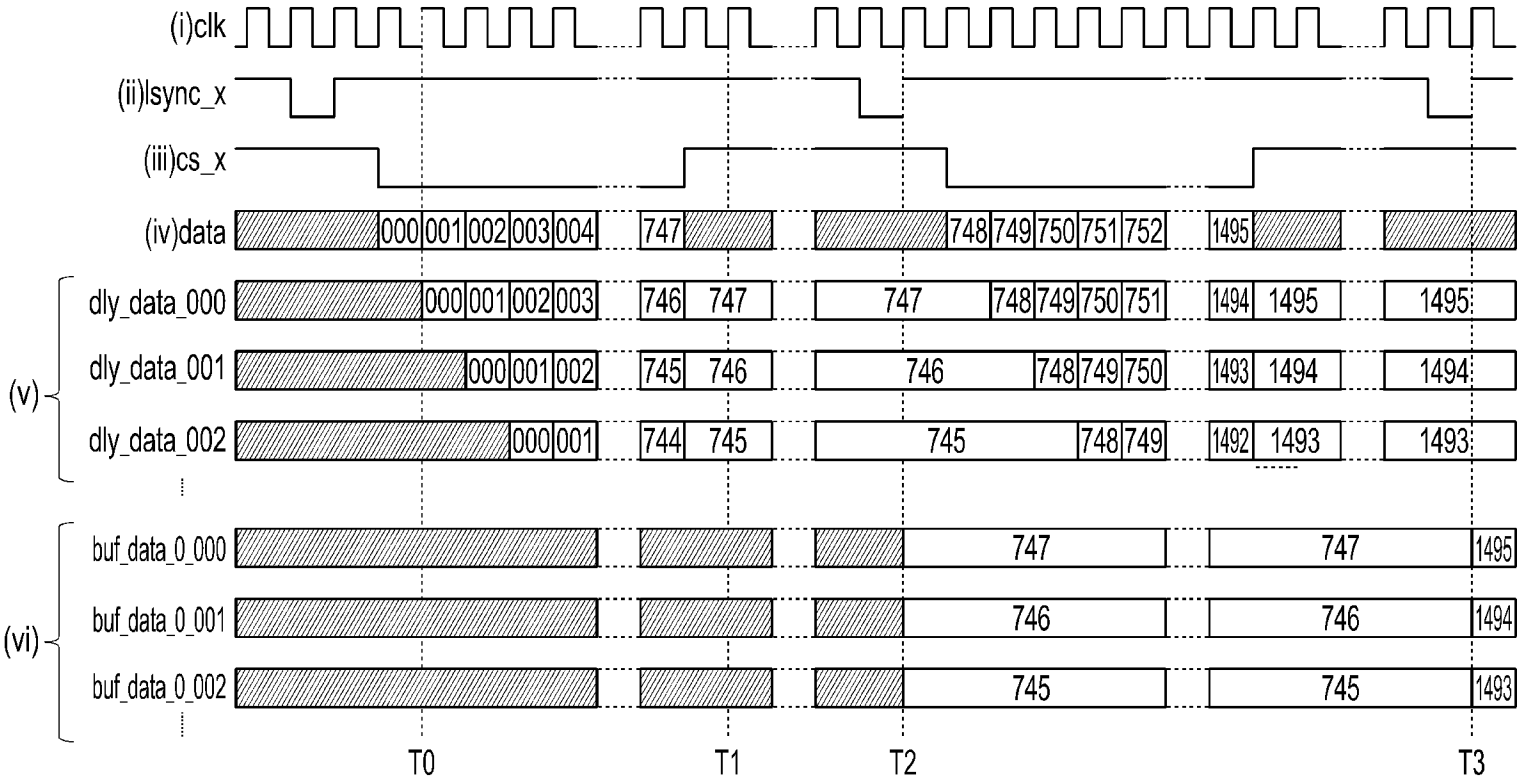
FIG. 9A and FIG. 9B are an illustration of a waveform of each signal and shift of image data in Embodiment 1.

FIG. 9A is a timing chart showing the operation in the longitudinal direction of the light emitting device 401 of the image data storage portion 804 in the high resolution mode, that is, when the resolution mode signal is "1". FIG. 9A shows the waveform of the clock signal clk in (i), the waveform of the line synchronization signal lsync_x in (ii), the waveform of the chip select signal cs_x in (iii), and (iv) indicates the image data signal data by 000 to 747. Here, value "747" indicates image data corresponding to the lower electrode 410-1, and "000" indicates image data corresponding to the lower electrode 410-748. The shaded portion of the image data signal data indicates invalid data as image data. Part (v) shows the image data dly_data_000 and so on which are the output of the flip-flop circuit 811 and (vi) shows the image data buf_data_0_000 and so on which is the output of the flip-flop circuit 812.

During the period from time T0 to time T1 in which the chip select signal cs_x is 0 (cs_x=0 (low level)), the image data is shifted as follows by way of the flip-flop circuit 811 connected in series. The time T0 is the time when cs_x=0 is captured at the rising edge of the clock signal clk. That is, the shifting occurs in the order of data→dly_data_000→dly_data_001→ . . . →dly_data_747 and so on. In the high resolution mode, the flip-flop circuit 811 operates as a shift register, and the input image data is sequentially transferred to the flip-flop circuits 811-1, 811-2 . . . . While the chip select signal cs_x is at a low level (cs_x=0), it is assumed that the same number of clock signals clk as the number of lower electrodes 410 in the longitudinal direction of the light emitting device 401, that is, 748 signals are inputted. By doing so, image data covering one line is held in dly_data_000 to dly_data_747.

Since the chip select signal cs_x is 1 (cs_x=1 (high level)) after the time T1, the shift operation is not performed and the image data at the time T1 is held. For example, the image data dly_data_000 held in the first flip-flop circuit 811 after time T1 is 747. When the line synchronization signal lsync_x becomes 0 (lsync_x=0 (low level)) at time T2, the image data for one line is simultaneously outputted to the pulse signal generating portion 805 as buf_data_0_000 to buf_data_0_747. The time T2 is the time when lsync_x=0 is captured at the rising edge of the clock signal clk. That is, the image data dly_data_000 and the like held in the flip-flop circuit 811 is outputted to the pulse signal generating portion 805 as image data buf_data_0_000 and the like by way of the flip-flop circuit 812 to drive each lower electrode 410. After time T2, the same operation is repeated, and the image data outputted to the pulse signal generating portions 805-1, 805-2 are sequentially renewed for each line synchronization signal lsync_x. Here, in the high resolution mode, the cycle of the line synchronization signal lsync_x is 105.8 s, and the image data is renewed in this cycle.

(In Low Resolution Mode)

Figure 9B:
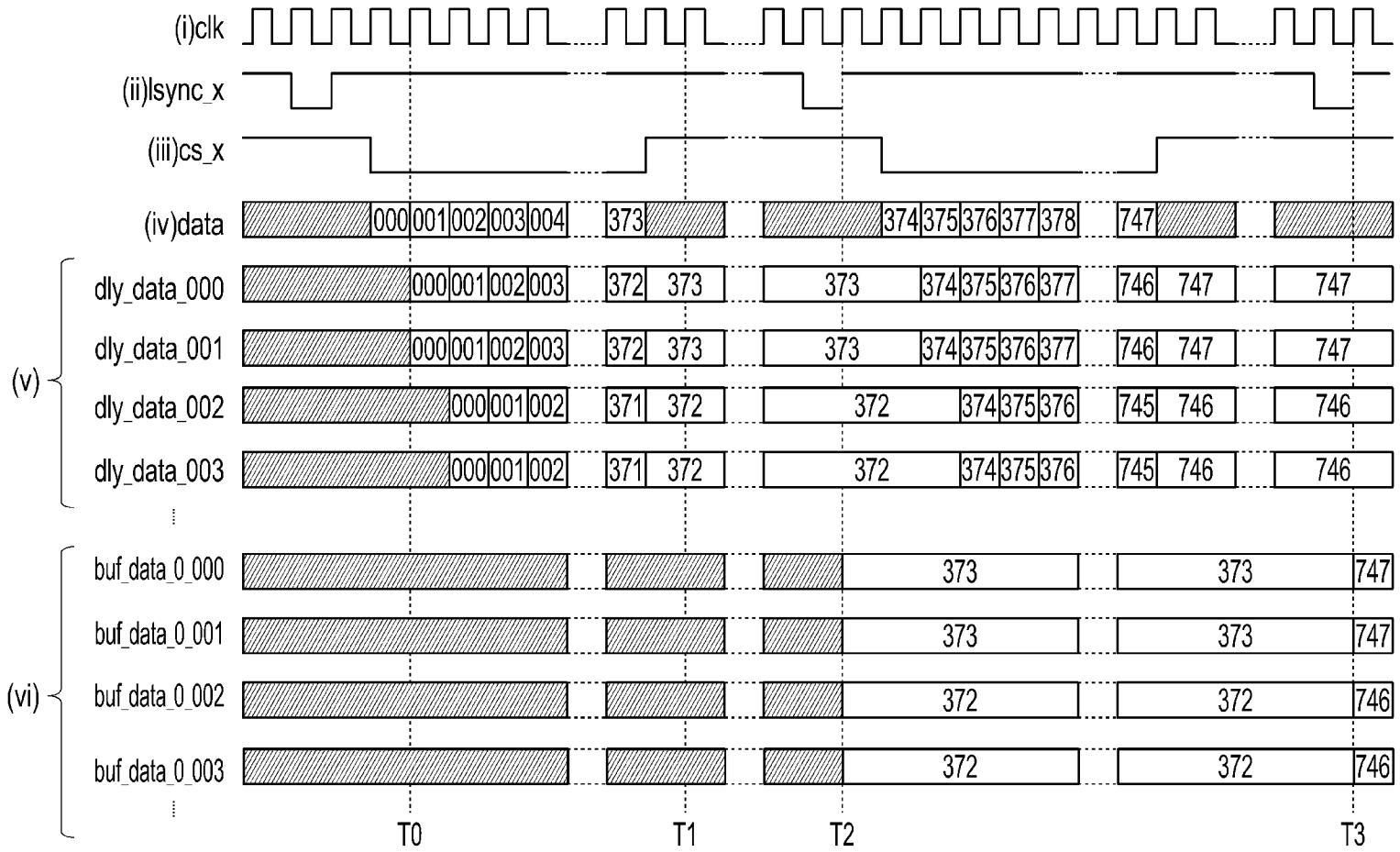

FIG. 9B is a timing chart showing the operation in the longitudinal direction of the light emitting device 401 of the image data storage portion 804 in the low resolution mode, that is, when the resolution mode signal is "0". In FIG. 9B, parts (i) to (vi) are the graphs similar to graphs of parts (i) to (vi) of FIG. 9A.

The image data signal data is sequentially inputted to the flip-flop circuit 811 from 000 from time T0 to time T1 when the chip select signal cs_x is 0 (cs_x=0 (low level)) captured at the rising edge of the clock signal clk. However, in the low resolution mode, the selectors 813-1 . . . are provided before the even-numbered flip-flop circuits 811-2, 811-4 . . . . By the selector 813, the same image data is transferred with the image data dly_data_2*n* and dly_data_2*n*+1 (n≤0) as one set. More specifically, the same image data is inputted to dly_data_000 and dly_data_001, and the same data is inputted to dly_data_002 and dly_data_003. As described above, the image data signal data is input to two adjacent flip-flop circuits 811 and the data amount is doubled for each pixel and transferred.

When the line synchronization signal is 0 (lsync_x=0 (low level)) at the time T2 at the rising edge of the clock signal clk, the image data is transferred as follows. That is, the data is transferred in the order of dly_data_000→buf_data_0_000 and dly_data_001→buf_data_0_001. By this, the image data buf_data_0_000, buf_data_0_001 are outputted to the pulse signal generating portions 805-1, 805-2 . . . , and drive the respective lower electrodes 410. The same operation is repeated after time T2, and the image data outputted to the pulse signal generating portions 805-1, 805-2 . . . are sequentially renewed for each line synchronization signal lsync_x. Here, the cycle of the line synchronization signal lsync_x is 211.6 μs in the low resolution mode, and the image data is renewed in this cycle.

The low resolution mode operation is also possible by transferring the image data as described above, even if the number of lower electrodes 410 in the lower electrode 410 is the same as the number of pixels corresponding to the high resolution mode in the main scanning direction. That is, in the low resolution mode, the image data is transferred so that two consecutive lower electrodes of the lower electrode 410 are driven based on the same image data. By doing so, the resolution conversion in the main scanning direction is effected within the printed circuit board 202. In addition, in the high-resolution mode in the sub-scanning direction, the lines are formed at the cycle of the line synchronization signal lsync_x, and therefore, the lines are formed at 1200 dpi intervals. On the other hand, in the low resolution mode, the lines are formed at 600 dpi intervals in the sub scanning direction.

In Embodiment 1, by transferring the image data in this manner, the lower electrode 410 has the same number of elements in the main scanning direction as in the high resolution mode, but in the low resolution mode, data transfer is performed so that two consecutive lower electrodes of the lower electrode 410 are driven by the same data. By this, the resolution is converted in the main scanning direction.

(Pulse Signal Generating Portion)

The pulse signal generating portion 805 will be described. When the number of the lower electrodes 410 is n, the same number (n) of the pulse signal generating portions also exist. In Embodiment 1, the pulse signal generating portions 805-1 to 805-748 are provided for the lower electrodes 410-1 to 410-748. Here, the structure of the pulse signal generating portion 805 included in each lower electrode 410 is the same. Therefore, here, the pulse signal generating portion 805-1 will be described as an example.

Figure 10:
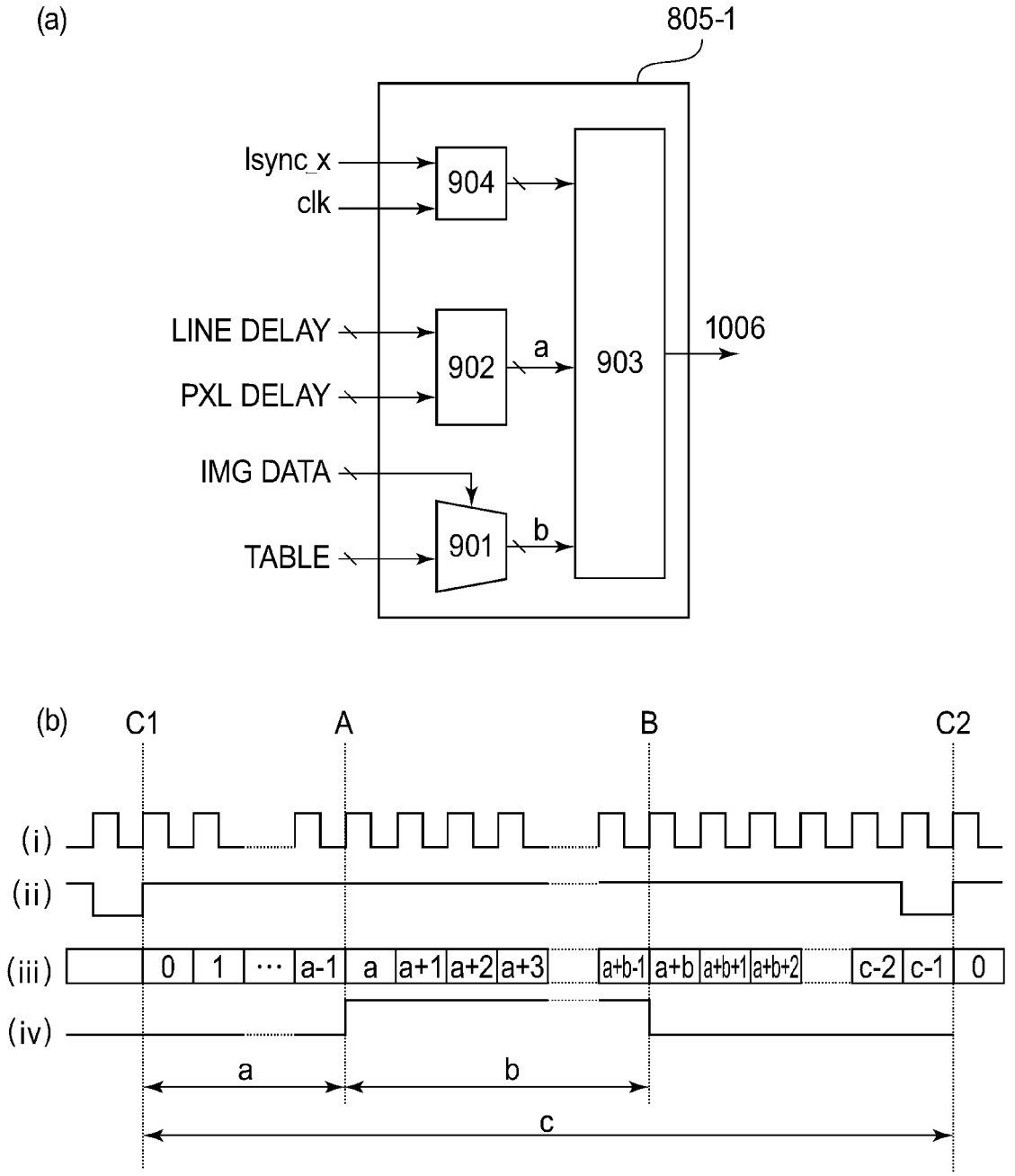
FIG. 10 is an illustration of a pulse signal generating portion in Embodiment 1 and a waveform of each signal.

Part (a) of FIG. 10 is a block diagram of the pulse signal generating portion 805-1. The pulse signal generating portion 805-1 includes a pulse width selecting portion 901, an adder portion 902, an output determining portion 903, and a counter portion 904. The pulse width selecting portion 901 converts the image data inputted from the image data storage portion 804 into the pulse width b in accordance with the pulse width table for the pulse signal set by the register portion 802. Table 1 shows an example of the pulse width table, which is a conversion table when converting the image data to pulse width b.

TABLE 1

| Image data [3; 0] | Pulse width b |
|---|---|
| 0 | 0 |
| 1 | 4 |
| 2 | 8 |
| 3 | 12 |
| 4 | 16 |
| 5 | 20 |
| 6 | 24 |
| 7 | 28 |
| 8 | 32 |
| 9 | 36 |
| 10 | 40 |
| 11 | 44 |
| 12 | 48 |
| 13 | 52 |
| 14 | 56 |
| 15 | 60 |

Table 1 shows the image data in the first column and the pulse width b of the pulse signal corresponding to the image data in the second column. For example, the image data is four-bit data ([3:0]) (0 to 15).

For example, when the number of input image data is 2, the pulse width selecting portion 901 outputs the pulse width b of 8 to the output determining portion 903 based on the pulse width of Table 1 set by the register portion 802. However, the pulse width Table shown in Table 1 is an example, and the bit width of the image data and the pulse width may be different from the example of Table 1, and the value of the pulse width b can be set arbitrarily. The pulse width table stored in the register portion 802 may be set individually for each lower electrode 410 or may be common.

The light emitting layer 450 corresponding to the lower electrode 410 may have different light amounts even when the pulse signals have the same pulse width, due to process variations and the like. The variations in the amount of light of the light emitting layers 450 corresponding to the lower electrodes 410-1 to 410-748 result in unevenness in the electrostatic latent image formed on the photosensitive drum 102, that is, result in unevenness in the printed image. In order to eliminate the unevenness of the electrostatic latent image, the pulse width Table is set for each of the lower electrodes 410-1 to 410-748 depending on the measured light intensity, so that the correct electrostatic image corresponding to the inputted image data can be provided, by changing the pulse width of the output pulse signal. By setting the pulse width table for each of the lower electrodes 410-1 to 410-748 using the above-described control, it is possible to correct the unevenness of the print image of the printed image caused by the variation in the light amount of each light emitting layer 450 corresponding to the lower electrodes 410-1 to 410-748.

The adder portion 902 adds a line delay signal common to all pulse signal generating portions 805 and a pixel delay signal different for each pulse signal generating portion 805. By this, the adder portion 902 determines the delay time an of the pulse signal. The counter portion 904 counts the clock signal clk and resets the count for each cycle (hereinafter, referred to as line synchronization signal cycle) c of the line synchronization signal lxync_x. The line synchronization signal period is shown as timing C-1 and C-2 in part (b) of FIG. 10 which will be described hereinafter. The count is inputted to the output determining portion 903. In Embodiment 1, the counting method of the clock signal clk is up-counting, but it may count-down type. The counter portion 904 may be provided for each pulse signal generating portion 805 corresponding to each lower electrode 410, or it may be common.

Referring to part (b) of FIG. 10, the operation of output determining portion 903 will be described. In part (b) of FIG. 10, (i) shows the waveform of the clock signal clk, and (ii) shows the waveform of the line synchronization signal lsync_x. Part (iii) shows the count value outputted from the counter portion 904, and (iv) shows the waveform of the pulse signal generated by the pulse signal generating portion 805.

The output determining portion 903 generates a pulse signal depending on the count inputted from the counter portion 904, the delay time an outputted from the adder portion 902, and the pulse width b outputted from the pulse width selecting portion 901. The output determining portion 903 sets the output pulse signal to high level at the timing (timing A) when the count becomes a from the timing (timing C-1 and C-2) when the line synchronization signal lsync_x is at the low level in the rising edge of the clock signal clk. The output determining portion 903 then sets the output pulse signal to the low level at the timing (timing B) at which the count becomes a+b when the clock signal clk rises and the count has passed the pulse width b. By this, the output determining portion 903 generates the pulse signal. The pulse width Table, the line delay signal and the pixel delay signal are transmitted from the register portion 802, and the values can be changed in clock cycle units by rewriting the information in the register portion 802.

[Analog Portion]

Figure 11:
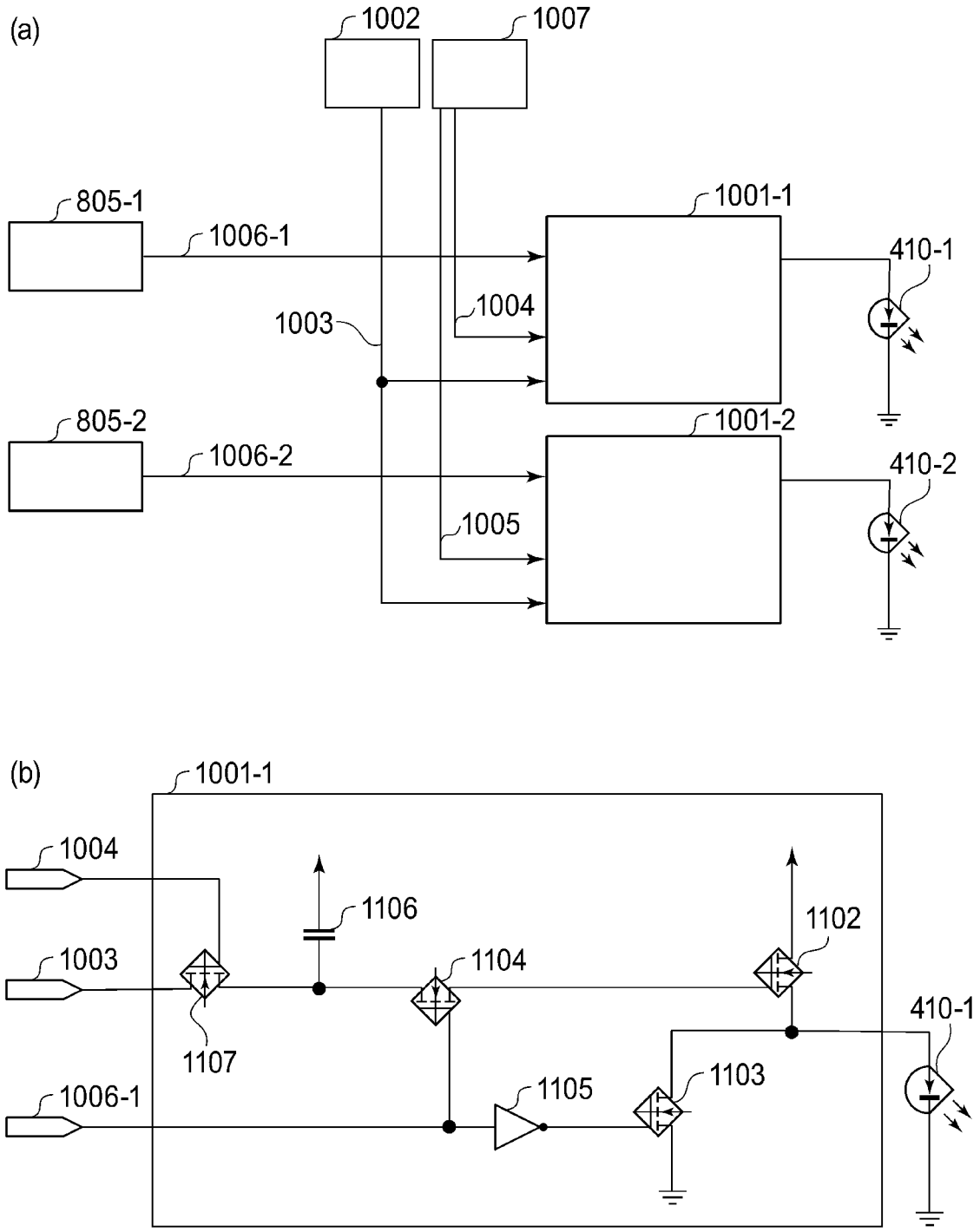
FIG. 11 is a block diagram of an analog portion and a circuit illustration of a driving portion in Embodiments 1 and 2.

Part (a) of FIG. 11 shows a block diagram of the analog portion 806. In Example 1, for the purpose of simplification of explanation, the driving portions 1001-1 and 1001-2 for driving the two lower electrodes 410-1 and 410-2 of the lower electrodes 410-1 to 410-748 will be described with reference to the drawings. However, the similar driving portions 1001-3 to 1001-748 are formed corresponding to the lower electrodes 410-3 to 410-748. In addition, as described above, it is the light emitting layer 450 in the regions corresponding to the lower electrodes 410-1 and 410-2 that actually emit light by driving the lower electrodes 410-1 and 410-2.

The pulse signal generating portions 805-1 and 805-2 generate pulse signals which control the light emission (ON) timing of the lower electrodes 410-1 and 410-2. The pulse signal generating portions 805-1 and 805-2 input pulse signals to the driving portions 1001-1 and 1001-2 by way of the pulse signal lines 1006-1 and 1006-2.

The digital-to-analog converter (hereinafter referred to as DAC) 1002 supplies the analog voltage which determines the drive current to the driving portions 1001-1 and 1001-2 by way of the signal line 1003 based on the data set in the register portion 802. The driving portion selecting portion 1007 feeds a drive selection signal for selecting the driving portion 1001-1, 1001-2 on the basis of the data set in the register portion 802, to the driving portion 1001-1, 1001-2 by way of the signal lines 1004 and 1005. The driving portion select signal is generated so that only the signal connected to the selected driving portion 1001 becomes high level. For example, when the driving portion 1001-1 is selected, the high-level driving portion select signal is supplied only to the signal line 1004, and the low level driving portion select signal is supplied the signal line 1005 and other signal lines 1005 connected to other driving portions 1001-2 and the like. In Example 1, the driving portion select signal is based on positive logic, but it may be negative logic.

The driving portions 1001-1 and 1001-2 each set the analog voltage inputted by way of the signal line 1003 at the timing selected by the driving portion selecting portion 1007 (the timing when the driving portion select signal becomes high level). The CPU 703 sequentially selects the driving portions 1001-1 and 1001-2 through the register portion 802 and sets the voltage corresponding to the selected driving portions 1001-1 and 1001-2. By this, the CPU 703 sets the analog voltage of all the driving portions 1001 with one DAC 1002. The analog voltage and the pulse signal which determine the drive current are inputted to the driving portions 1001-1 and 1001-2 by the above-described operation, and the lower electrodes 410-1 and 410-2 are independently controlled by the drive circuit which will be described below, in the drive current and light emission time.

(Driving Portion)

Part (b) of FIG. 11 shows a circuit of the driving portion 1001-1 which drives the lower electrode 410-1. Here, the driving portions 1001-2 to 1001-748 for the other lower electrodes 410-2 to 410-748 are also driven by the same circuit. MOS field effect transistor (hereinafter referred to as MOSFET) 1102 supplies a drive current to the lower electrode 410-1 depending on the gate voltage value, and when the gate voltage is at low level, the drive current is turned off (light off) by controlling the current.

A pulse signal line 1006-1 is connected to the gate terminal of the MOSFET 1104, and the voltage charged in the capacitor 1106 when the pulse signal is high level is transferred to the MOSFET 1102. The driving portion select signal (transmitted from the signal line 1004) transmitted from the driving portion selecting portion 1007 is connected to the gate terminal of the MOSFET 1107. The MOSFET 1107 turns on when the received driving portion select signal is at a high level, and charges the capacitor 1106 with the analog voltage (transmitted from the signal line 1003) outputted from the DAC 1002. In Embodiment 1, the DAC 1002 sets the analog voltage to the capacitor 1106 at the timing before the image formation and keeps the voltage level by turning off the MOSFET 1107 during the image formation period.

By such an operation, the MOSFET 1102 supplies the drive current to the lower electrode 410 in accordance with the set analog voltage and pulse signal. If the input capacitance of the lower electrode 410-1 is large and the response speed when off is slow, the off speed can be increased by the MOSFET 1103. The gate signal of the MOSFET 1103 is the signal obtained by logically inverting the pulse signal from the inverter 1105. When the pulse signal is at low level, the gate terminal of MOSFET 1103 becomes high level to forcibly discharge the charge stored up to the input capacitance of the lower electrode 410-1.

[Latent Image on Photosensitive Drum]

Figure 12:
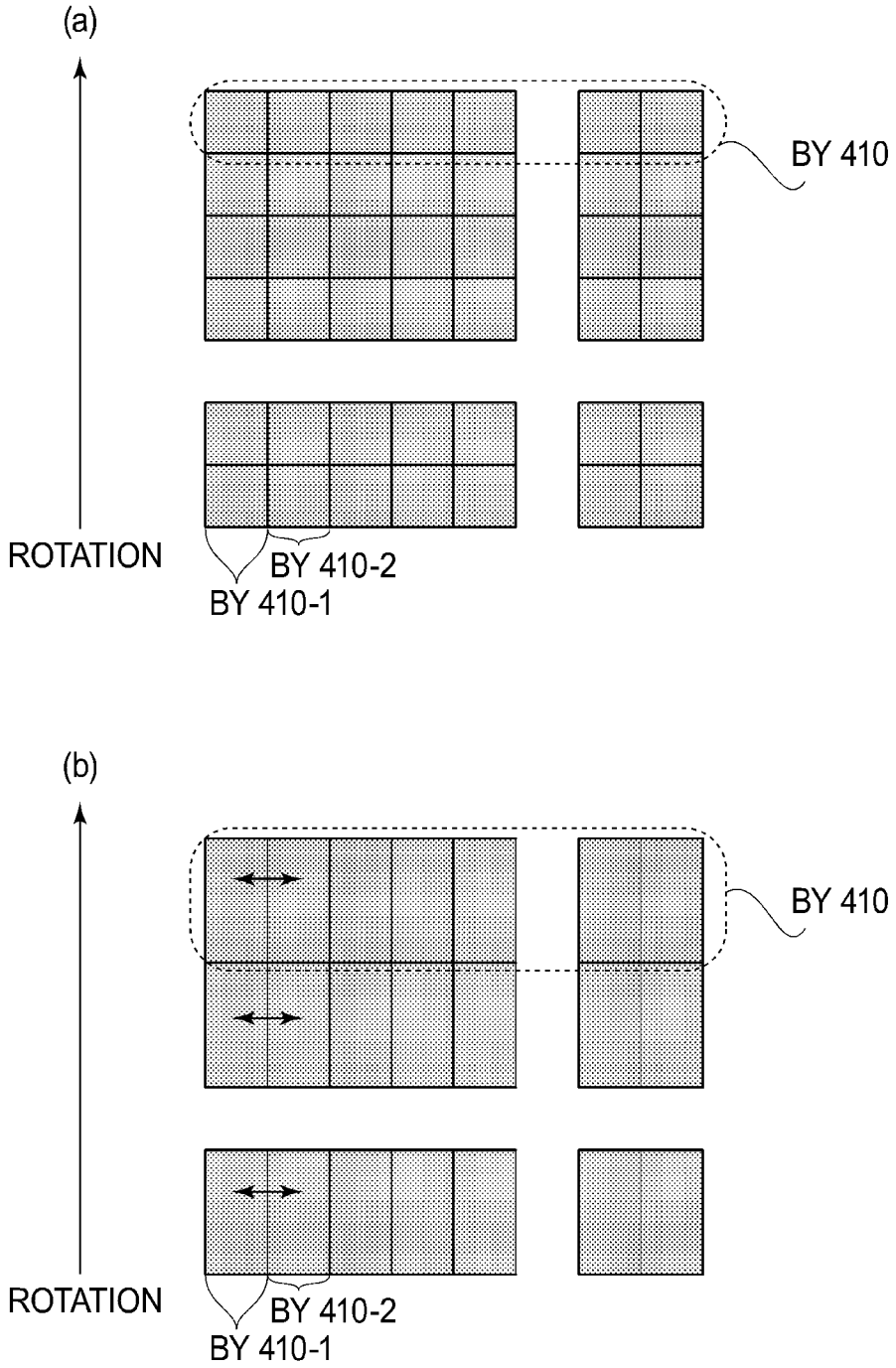
FIG. 12 is a view illustrating a latent image on the photosensitive drum in Embodiment 1.

FIG. 12 is a schematic illustration showing a latent image on the photosensitive drum 102 formed by the operation in Embodiment 1, and also shows the rotational direction of the photosensitive drum 102. A portion indicated by a broken line in the Figure shows a latent image corresponding to a pixel formed by the lower electrode 410, the light emitting layer 450, and the upper electrode 460 (hereinafter referred to as the lower electrode 410 and so on). In addition, one square in the direction perpendicular to the rotational direction shows a latent image corresponding to the pixel formed by the lower electrodes 410-1, 410-2 . . . . Part (a) of FIG. 12 is a schematic view of a latent image formed on the photosensitive drum 102 in the high resolution mode. In the high resolution mode, a latent image of 1200 dpi is formed in both the direction perpendicular to the rotational direction of the photosensitive drum 102 and the parallel direction.

Part (b) of FIG. 12 is a schematic view of a latent image formed on the photosensitive drum 102 in the low resolution mode. In the low resolution mode, a latent image of 600 dpi is formed in a direction perpendicular to the rotational direction of the photosensitive drum 102 and a direction parallel thereto. However, in the direction perpendicular to the rotational direction, an image based on the same image data is formed every two pixels, in other words, using two adjacent lower electrodes 410 (shown as "same data"). For this reason, the resolution is a latent image equivalent to 600 dpi. In addition, the line synchronization signal lsync_x is output at a cycle corresponding to 600 dpi even in the direction parallel to the rotational direction of the photosensitive drum 102, and therefore, 600 dpi pixels are formed.

As described above, by providing a circuit for converting the resolution inside the light emitting device 401, it is possible to handle both a high resolution image and a low resolution image using the same exposure head. In addition, the conversion is effected to the same resolution as the lower electrode of the light emitting device 401 (in other words, the light emitting point) irrespective of the input resolution, and therefore, a stable image can be formed without a difference in the distance of the light emitting points depending on the resolution. Here, in Embodiment 1, the same image controller portion 700 can output both low-resolution and high-resolution images. However, with the exposure head having this structure, the same exposure head can be connected to an image controller portion which can output only low resolution and also to an image controller portion that can output only high resolution.

As described above, according to Embodiment 1, the same exposure head can be used for both the high-resolution image and the low-resolution image without degrading the image quality.

Embodiment 2

Light-emitting devices using organic EL generally tend to have a relatively low emission brightness as compared to laser diodes and the like. In particular, when one cycle of the line synchronization signal lsync_x is short as in the high resolution mode of Embodiment 1, the exposure time of one pixel (or one line) is short, which may make it difficult to form a latent image on the photosensitive drum 102. Under the circumstances, in Embodiment 2, the lower electrodes 410 are arranged in two rows. Here, the structure of the entire image forming apparatus, the structure of the exposure head, and the structure of the substrate are the same as those in Embodiment 1, and therefore, the differences from Embodiment 1 will be described.

[Arrangement of Multiple Lower Electrodes in the Emission Area (Multiple Emission)]

Figure 13:
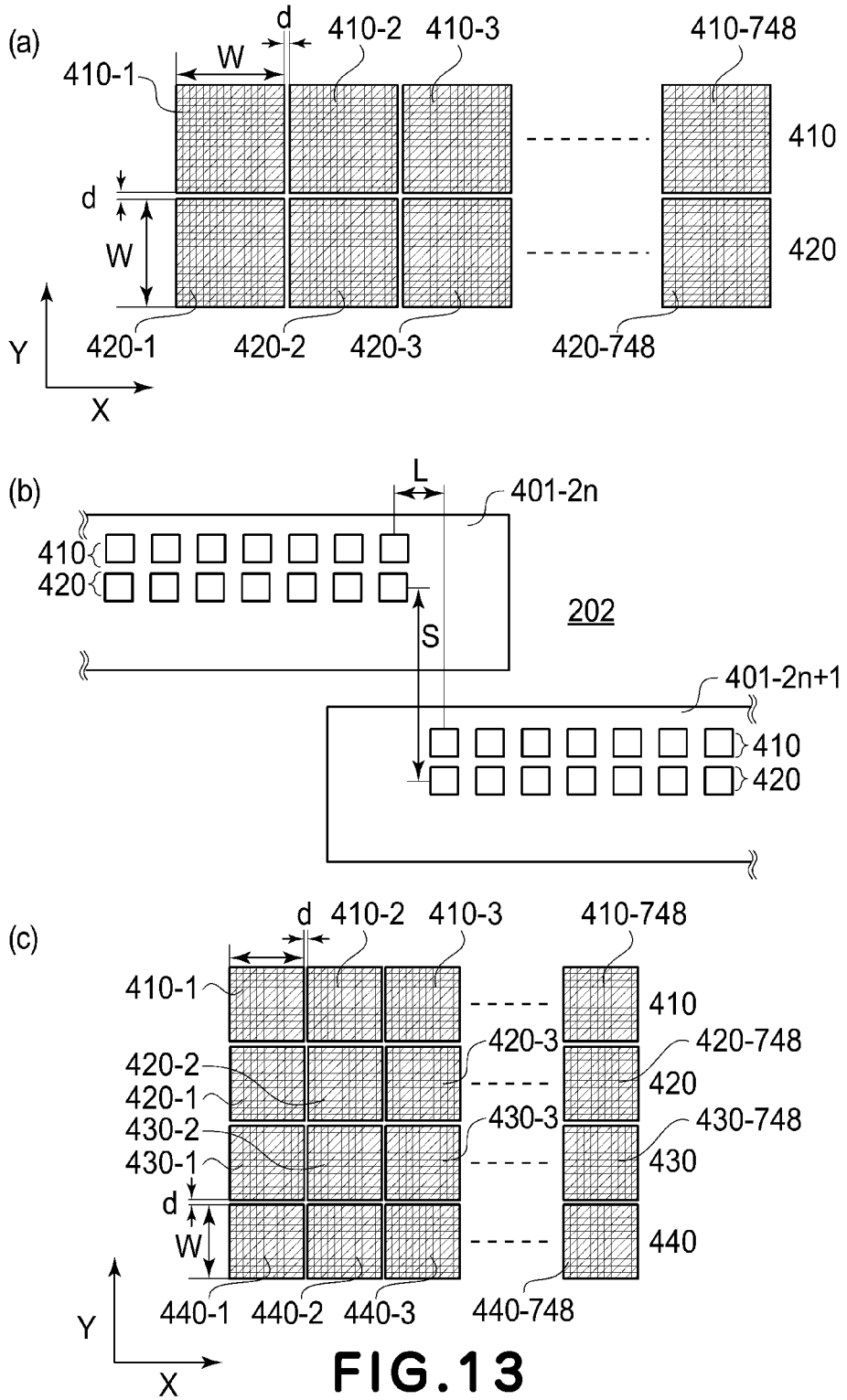
FIG. 13 is an illustration of a structure of the printed circuit board in Embodiment 2, and a structure illustration of a silicon substrate.

As shown in FIG. 13, the light emitting device 401 of Embodiment 2 includes lower electrodes 420-1 to 420-748 in addition to the lower electrodes 410-1 to 410-748. The lower electrodes 420-1 to 420-748 are a plurality of electrodes formed in layers (first electrode layer) on the silicon substrate 402, like the lower electrodes 410-1 to 410-748. The lower electrodes 420-1 to 420-748 are the second electrode row. The lower electrodes 420-1 to 420-748 forming the second electrode array are arranged along the direction of the rotation axis of the photosensitive drum 102. Here, the lower electrodes 420-1 to 420-748 may be arranged at an angle of ±1° with respect to the direction of the rotation axis of the photosensitive drum 102. It is not necessary that the photosensitive drums 102 are strictly aligned parallel to the rotation axis direction.

That is, the light emitting device 401 includes lower electrodes arranged two-dimensionally. The lower electrodes 420-1 to 420-748 have the same size, shape, and arrangement in the X direction as those of the lower electrodes 410-1 to 410-748, and therefore, the description thereof is omitted for simplification.

The lower electrodes 420-1 to 420-748 (second electrode array) are arranged in the Y direction with a space d relative to the lower electrodes 410-1 to 410-748 (first electrode array). The lower electrode 420-1 is arranged adjacent to the lower electrode 410-1 in the Y direction, and similarly, the lower electrode 420-2 to the lower electrode 420-748 are arranged adjacent to the lower electrode 410-2 to the lower electrode 410-748, respectively. Here, the Y direction is a direction substantially parallel to the rotational direction of the photosensitive drum 102. That is, the direction in which the first electrode row and the second electrode row are arranged may be inclined by approximately ±1° relative to the rotational direction of the photosensitive drum 102. Here, it is not always necessary to design the distance between the lower electrodes in the X direction and the distance between the lower electrodes in the Y direction to be the same as in Embodiment 2, but, in order to arrange the lower electrodes efficiently within the specified area, the distance between the lower electrodes in both directions are preferably designed equal. In addition, Embodiment 2 exemplifies the light emitting device including two electrode rows for simplification of description, but as shown in part (c) of FIG. 13, the electrode row may be in any number of rows, that is, 3 or more. For example, similar to the structure described above, the lower electrodes 430-1 to 430-748 may be arranged adjacent to lower electrodes 420-1 to 420-748, respectively, and further, the lower electrodes to lower electrodes 430-1 to 430-748. 440-1 to 440-748 may be arranged adjacent to each other. In the following, in order to simplify the explanation, the light emitting device 401 including the lower electrodes 410-1 to 410-748 and the lower electrodes 420-1 to 420-748 will be described as an example.

When the lower electrode 410-1 and the lower electrode 420-1 are simultaneously driven, the distance between the center positions exposed by the driving of both electrodes on the photosensitive drum 102 is shifted by W+d in the rotational direction of the photosensitive drum 102. The image forming apparatus according to the present exemplary embodiment drives the plurality of lower electrodes (for example, the lower electrode 410-1 and the lower electrode 420-1) which are adjacent to each other in the rotational direction of the photosensitive drum 102, thereby exposing the area corresponding to one pixel in the output resolution of the image forming apparatus. Therefore, an area corresponding to one pixel can be exposed a plurality of times by providing a time difference between the timing of voltage application to the lower electrode 410-1 and the timing of voltage application to the lower electrode 420-1 depending on the rotation speed of the photosensitive drum 102 (multiple exposure).

The lower electrodes 410 and 420 are arranged in a row at a predetermined interval in the X direction in the Figure, for example, at a pitch of 21.16 μm when the resolution is 1200 dpi. In addition, the lower electrodes 410 and 420 are arranged in the Y direction with a pitch of 21.16 μm. In the case of Embodiment 2, the width W is 20.9 μm, and the adjacent distance d is arranged at 0.26 μm pitch. Here, the cross-sections of the lower electrodes 410 and 420 are the same as in Embodiment 1.

Part (b) of FIG. 13 is an illustration showing a state of the boundary between the chips of the light emitting device 401 arranged in two rows in the longitudinal direction, and the horizontal direction shows the light emitting device group of part (a) of FIG. 3, in which a plurality of light emitting devices 401 are arranged in the longitudinal direction of 400. Part (b) of FIG. 13 shows a boundary portion between the chips of the light emitting device 401 (a portion where the ends of the chips overlap with each other in the longitudinal direction (overlap portion). The light emitting device 401 has a plurality of lower electrodes 410. Also at the boundary between the light emitting device **401-2*n* and the light emitting device 401-2*n*+1, the longitudinal pitch of the lower electrode 410** (the center point of the two lower electrodes and the distance (L) between the center points) is that corresponding to 1200 dpi, that is approximately 21.16 μm.

In addition, the light emitting devices 401 arranged in the upper and lower two rows in the lateral direction are arranged as follows. That is, the lower electrodes of the upper and lower light emitting devices 401 are arranged so that the distance between them (indicated by an arrow S in the Figure) is about 105 μm (5 pixels at 1200 dpi). In addition, the distance between the lower electrodes 410 in the longitudinal direction of the exposure head 106 (indicated by an arrow L in the Figure) is about 21.16 μm (one pixel at 1200 dpi). Here, also in Example 2, the intervals S and L between the light emitting devices 401 need not be limited to the values described above.

Figure 14A:
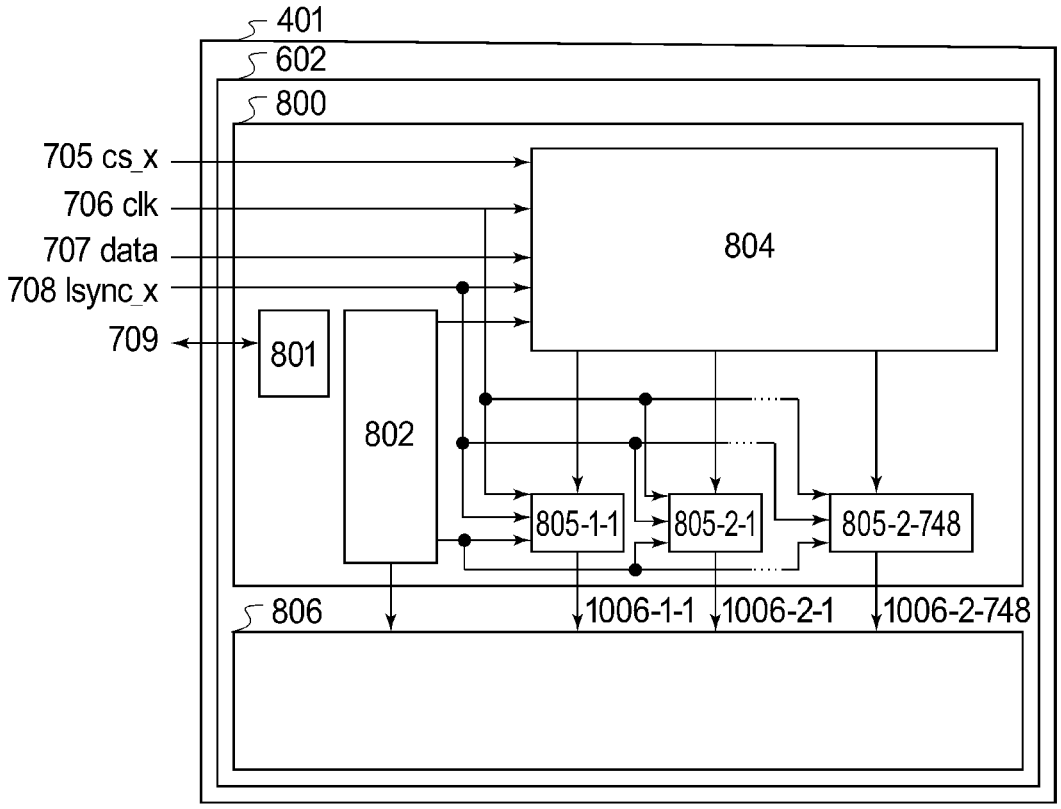
FIG. 14A and FIG. 14B are a circuit illustration inside the light-emitting device in Embodiment 2.
Figure 14B:
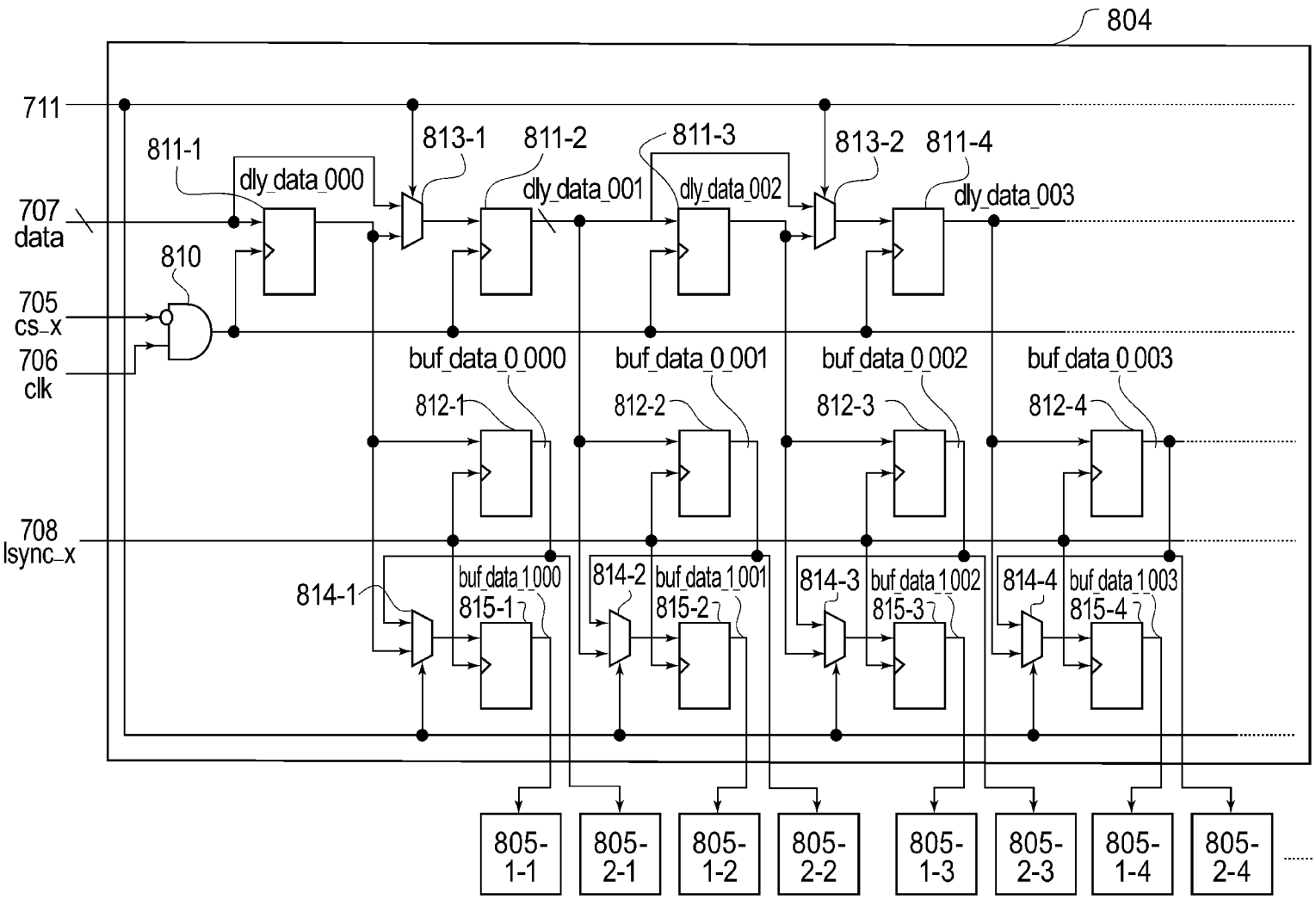

FIGS. 14A and 14B are a circuit block diagram illustration in the light emitting device 401. The circuit structure is the same as that of Embodiment 1. However, lower electrode 410 has been increased to 2 rows, and therefore, the number of pulse signal generating portions 805 is also doubled. More specifically, the pulse signal generating portions corresponding to the lower electrode 410 are 805-1-1, 805-1-2 . . . 805-1-748. In addition, the pulse signal generating portions corresponding to the lower electrode 420 are 805-2-1, 805-2-2 . . . 805-2-748. In addition, the pulse signal generating portions 805-1-1, 805-2-1, and so on are connected to the analog portion 806 by way of pulse signal lines 1006-1-1, 1006-2-1, and so on.

(Image Data Storage Portion)

Next, the operation of the image data storage portion 804 will be described. The chip select signal cs_x and the line synchronization signal lsync_x are negative logic signals, but, they may be positive logic signals. The resolution mode signal connected to the register portion 802 via the resolution mode signal line 711 corresponds to the low resolution mode (600 dpi) when "0" and to the high resolution mode (1200 dpi) when "1". The resolution mode signal is a register signal set depending on the operation of the image data generating portion 701. FIG. 8B is a circuit structure illustration of the image data storage portion 804. The clock gate circuit 810 outputs the logical product of the inverted signal of the chip select signal cs_x and the clock signal clk. The clock gate circuit 810 outputs the clock signal s_clk to the flip-flop circuit 811 only when the chip select signal cs_x is valid.

The flip-flop circuit 811 receives, as an original input, the image data signal data inputted to the image data storage portion 804. The same number of flip-flop circuits 811 as the lower electrodes 410 (748 in Embodiment 2) provided in the longitudinal direction of the light emitting device 401 are connected in series. In front of the data input terminal D of the even-numbered flip-flop circuits 811-2, 811-4, selectors 813-1, 813-2 . . . are connected. The resolution mode signal line 711 is connected to the selectors 813-1, 813-2, to which the select signal is inputted.

The flip-flop circuit 811 operates depending on the clock signal s_clk fed from the clock gate circuit 810. The output of the flip-flop circuit 811 is output. As the image data dly_data_000 to dly_data_747. To the next adjacently connected flip-flop circuit 811 or the selector 813 and the flip-flop circuit 812 and the selector 814. The number, corresponding to that of the lower electrodes 410 (748 in Embodiment 2), of the flip-flop circuits 811 and 812 are provided in the longitudinal direction of the lower electrode 410. The entire flip-flop circuit 811 functions as a shift circuit.

The flip-flop circuit 812 receives the output of the flip-flop circuit 811 as an input, and operates depending on the line synchronization signal lsync_x. The output of the flip-flop circuit 812 is outputted to the pulse signal generating portion 805 (805-2-1, 805-2-2, 805-2-3) and to the selector 814, as image data buf_data_0_000 to buf_data_0_747. Each of the flip-flop circuits 812 functions as a memory circuit, and the flip-flop circuits 812 provided for one lower electrode 420 function as a memory circuit group (or a second memory circuit group). The pulse signal generating portions 805-2-1, 805-2-2, 805-2-3, and so on function as a first pulse signal generating portion group which generates the first pulse signal.

The output of the selector 814 is connected to the flip-flop circuit 815. Like the selector 813, the resolution mode signal line 711 is connected to the selector 814, and the select signal is inputted. The selector 814 outputs the output of the flip-flop circuit 812 to the flip-flop circuit 815 when the resolution mode signal is "1". The selector 814 outputs the output of the flip-flop circuit 811 to the flip-flop circuit 815 when the resolution mode signal is "0". Specifically, the selector 814-2 will be described. The selector 814-2 outputs the output (buf_data_0_001) of the flip-flop circuit 812-2 to the flip-flop circuit 815-2 when the resolution mode signal is "1". The selector 814-2 outputs the output (dly_data_001) of the flip-flop circuit 81-2 to the flip-flop circuit 815-2 when the resolution mode signal is "0".

The output of the selector 814 is inputted to the flip-flop circuit 815. The output of the flip-flop circuit 815 is outputted as image data buf_data_1_000 to buf_data_1_747 to the pulse signal generating portion 805 (805-1-1, 805-1-2, 805-1-3 . . . ). Each of the flip-flop circuits 815 functions as a memory circuit, and the flip-flop circuits 815 provided for one lower electrode 410 function as a memory circuit group (or a first memory circuit group). The pulse signal generating portions 805-1-1, 805-1-2, 805-1-3, function as a second pulse signal generating portion group that generates the second pulse signal.

(In High Resolution Mode)

Figure 15A:
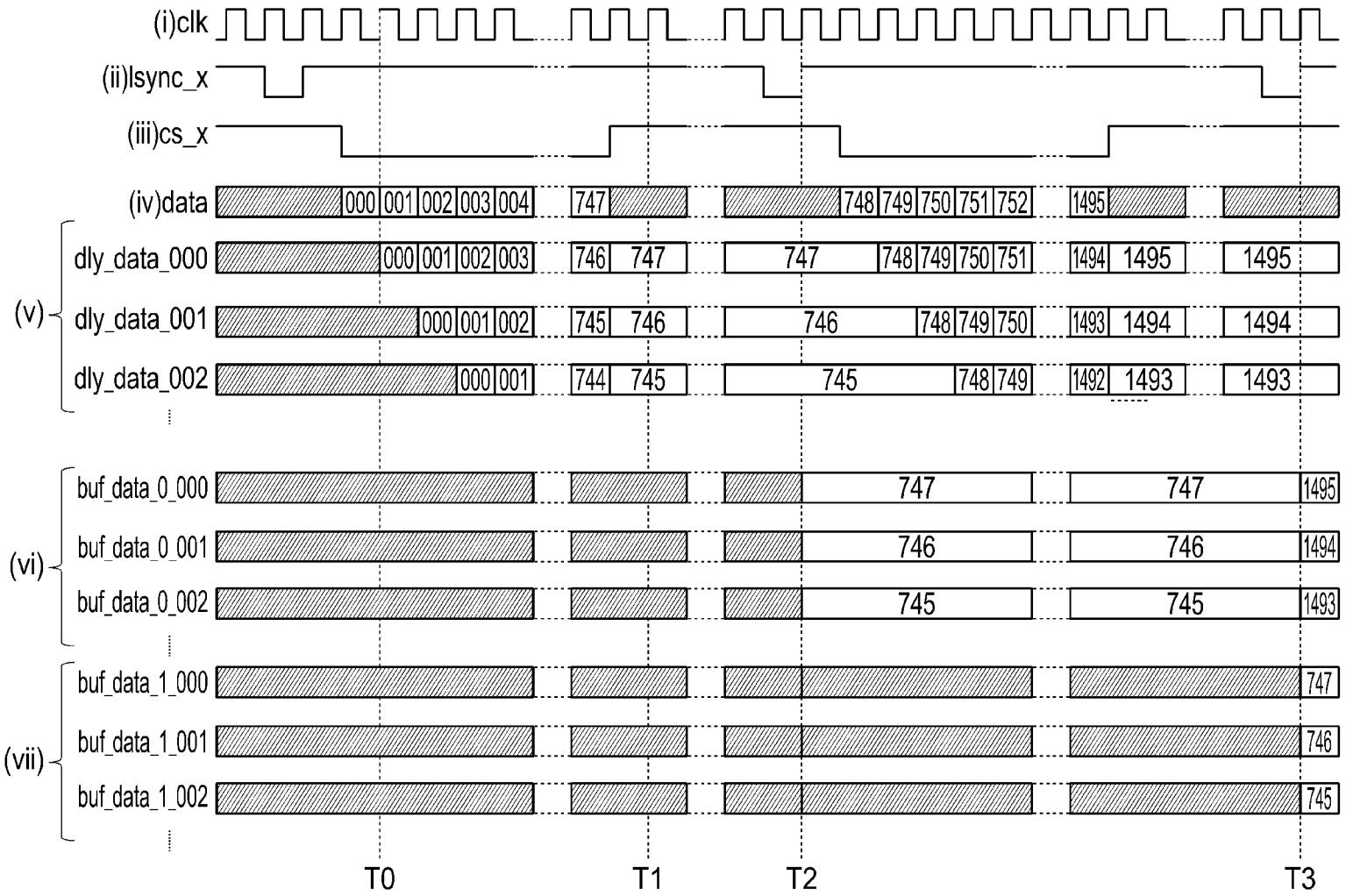
FIG. 15A and FIG. 15B are is an illustration of the waveform of each signal and the shift of image data in Embodiment 2.
Figure 15B:
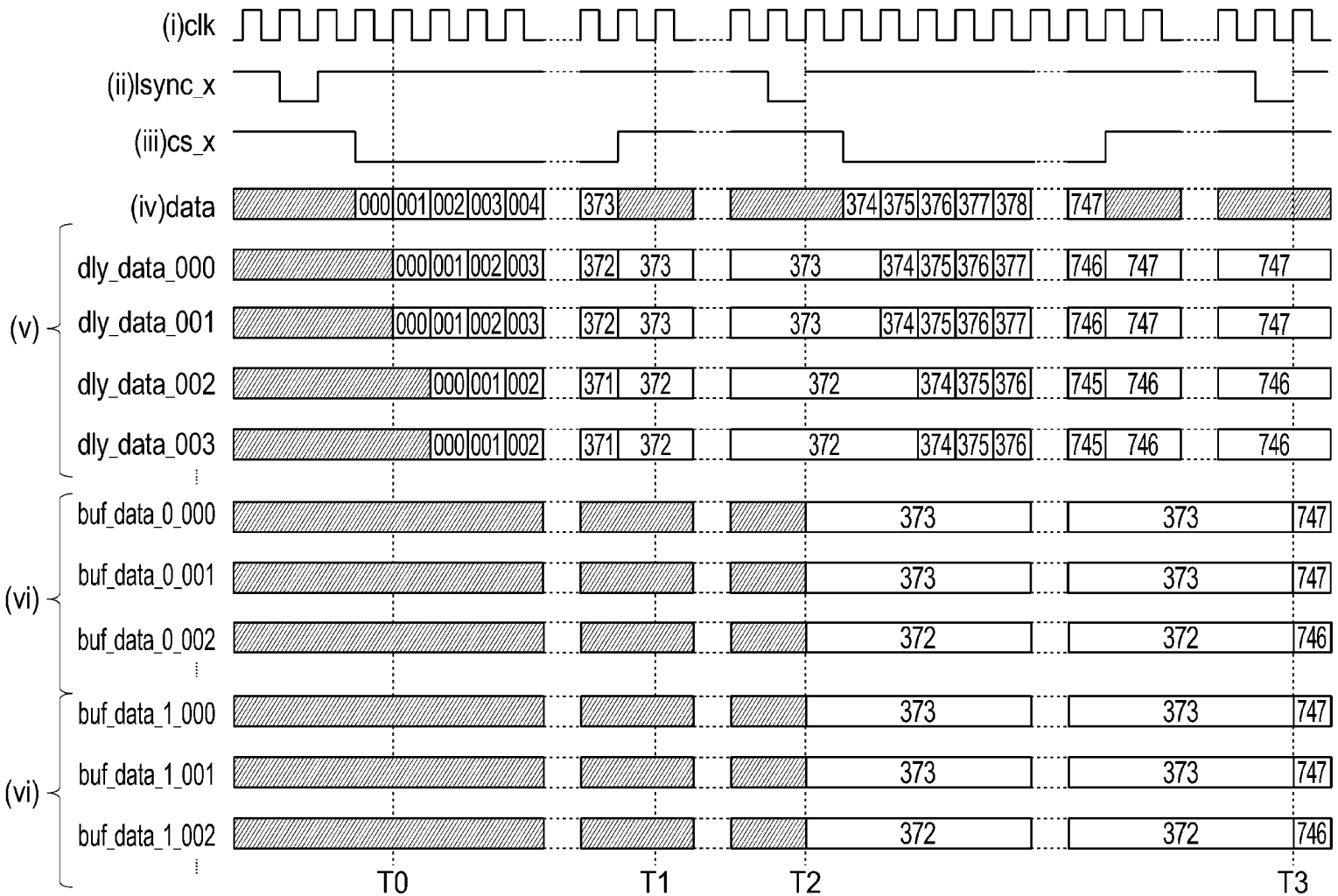

FIGS. 15A and 15B are a timing chart diagram of the image data storage portion 804 in the high resolution mode, that is, when the resolution mode signal is "1". Part (i) to (v) of FIG. 15A are the same graphs as sections (i) to (v) of FIG. 9A. Part (vi) in FIG. 15A shows the image data buf_data_0_000 or the like output from the flip-flop circuit 812, and (vii) shows the image data buf_data_1_000 or the like output from the flip-flop circuit 815.

When the chip select signal cs_x is 0 (cs_x=0 (low level)), that is, in the duration from time T0 to time T1, the image data is shifted as follows by way of the flip-flop circuit 811 connected in series. Time T1 is the time when cs_x=0 is captured at the rising edge of the clock signal clk. That is, it shifts in the order of data→dly_data_000→dly_data_001→ . . . →dly_data_747 and so on. During the period when the chip select signal cs_x is at low level (cs_x=0), the same number of clock signals clk as the number of lower electrodes in the longitudinal direction of the light emitting device 401, that is, 748 are inputted. By doing so, the image data for one line is held in dly_data_000 to dly_data_747.

Since the chip select signal cs_x is 1 (cs_x=1 (high level)) after the time T1, the shift operation is not performed and the image data at the time T1 is held. For example, the number of the image data dly_data_000 held in the first flip-flop circuit 811 after time T1 is 747. When the line synchronization signal lsync_x becomes 0 (lsync_x=0 (low level)) at time T2, the image data for one line is simultaneously outputted to the pulse signal generating portion 805 as buf_data_0_000 to buf_data_0_747. Time T2 is the time when lsync_x=0 is captured at the rising edge of the clock signal clk. That is, the image data dly_data_000 and the like held in the flip-flop circuit 811 is outputted to the pulse signal generating portions 805-2-1, 805-2-2 and the like as image data buf_data_0_000 and the like by way of the flip-flop circuit 812.

In addition, by the time the next line synchronization signal lsync_x is asserted, the next line of image data 748 to 1495 is transferred by way of the image data signal line 707. At time T3, the data for one line is transferred all at once, in such an order as buf_data_0_000→buf_data_1_000, buf_data_0_001→buf_data_1_001, and so on. That is, the image data buf_data_0_000 and the like held in the flip-flop circuit 812 is outputted to the pulse signal generating portions 805-1-1, 805-1-2 and the like as image data buf_data_1_000 and the like via the flip-flop circuit 815. As described above, the image data for two lines is outputted to the pulse signal generating portion 805.

(In Low Resolution Mode)

FIG. 15B is a timing chart of the image data storage portion 804 in the low resolution mode, that is, when the resolution mode signal is "0". In FIG. 15B, parts (i) to (vii) in FIG. 15B are graphs similar to (i) to (vii) in FIG. 15A. From the time T0 to the time T1 when the chip select signal is 0 (cs_x=0 (low level)) captured at the rising edge of the clock signal clk, the image data is shifted as follows by way of the flip-flop circuit 811 connected in series. Here, sequential input is effected from image data signal data, but the selector 813 is inserted in the preceding stage of the even-numbered flip-flop circuit 811. In the low resolution mode, the selector 813 transfers the same data as the image data signal data with dly_data_2*n* and dly_data_2*n*+1 (n≥0) as one set. More specifically, the same image data is inputted to dly_data_000 and dly_data_001, the same image data is inputted to dly_data_002 and dly_data_003. As described above, the image data signal data is transferred after being increased in data amount to twice the data amount of each pixel.

At time T2, the line synchronization signal lsync_x captures 0 (lsync_x=0 (low level)) at the rising edge of the clock signal clk. In the low resolution mode, the image data is selected by the selector 814 in the preceding stage of the flip-flop circuit 815 as follows so that buf_data_0_*n* and buf_data_1_*n* are the same image data. More specifically, the order is dly_data_000→buf_data_0_000 and buf_data_1_000, and dly_data_001→buf_data_0_001 and buf_data_1_001. Therefore, the image data for one line is simultaneously transferred so as to be copied as the image data for two lines, and is outputted to the pulse signal generating portion 805 as the data for two lines.

[Latent Image on Photosensitive Drum]

Figure 16:
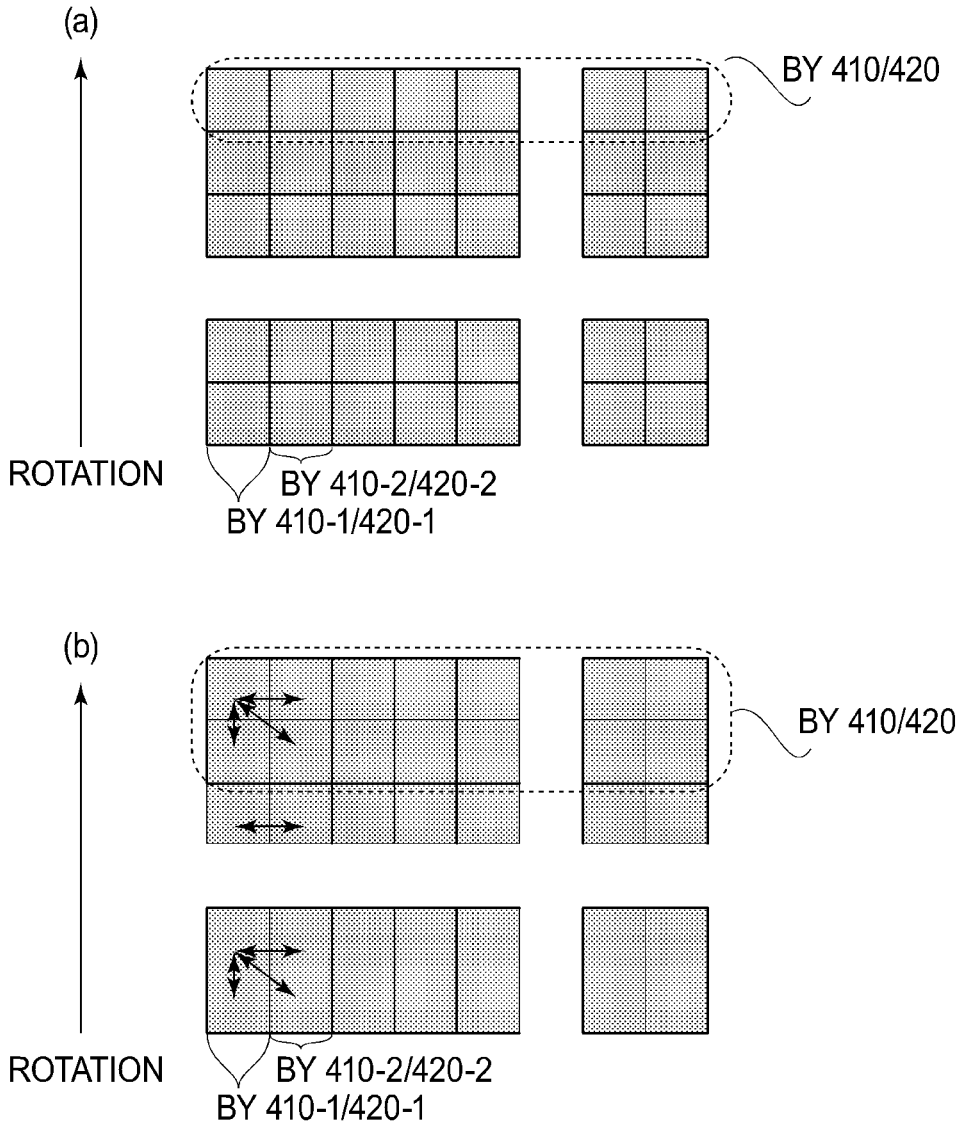
FIG. 16 is a view illustrating the latent image on the photosensitive drum in Embodiment 2.

FIG. 16 is a schematic illustration showing a latent image on the photosensitive drum 102 formed by the operation in Embodiment 2, and also shows the rotational direction of the photosensitive drum 102. The portion shown by the broken line in the Figure is the latent image corresponding to the pixel formed by the lower electrode 410 and the lower electrode 420. In addition, one square in the direction perpendicular to the rotational direction shows a latent image corresponding to a pixel formed by the lower electrode 410-1 and the lower electrode 420-1, the lower electrode 410-2, and the lower electrode 420-2. Part (a) of FIG. 16 is a schematic view of a latent image formed on the photosensitive drum 102 in the high resolution mode. In the high resolution mode, a latent image of 1200 dpi, which is similar to the resolution of the lower electrodes 410 and 420, is formed in the direction perpendicular to the rotational direction of the photosensitive drum 102. A 1200 dpi latent image is also formed in a direction parallel to the rotational direction of the photosensitive drum 102. In addition, the lower electrodes 410 and 420 of each pixel expose the same image data to the same pixel on the photosensitive drum 102 with a time difference, and therefore, A latent image of each pixel is formed by two exposures.

Part (b) of FIG. 16 is a schematic illustration of a latent image formed on the photosensitive drum 102 in the low resolution mode. In the low resolution mode, a latent image of 600 dpi is formed also in a direction perpendicular to the rotational direction of the photosensitive drum 102 and a direction parallel thereto. However, in the direction perpendicular to the rotational direction of the photosensitive drum 102, an image based on the same image data is formed every two pixels, in other words, by using two adjacent lower electrodes, and therefore, the latent image has a resolution of 600 dpi. In addition, an image based on the same image data is formed in the direction parallel to the rotational direction of the photosensitive drum 102, and therefore, images are formed at 1200 dpi, but, a latent image equivalent to 600 dpi is formed as the actual resolution.

As described above, in Embodiment 2 is the exposure head includes the light emitting device 401 in which the lower electrodes including a plurality of rows of the lower electrodes (two rows in the case of Embodiment 2) are two-dimensionally arranged. Even in this case, by the provision of the circuit for converting the resolution inside the light emitting device 401, it is possible to perform multiple exposure even when the light emission time for one pixel is short as in the high resolution mode. In addition, even in the low resolution mode, the resolution is converted to the same resolution as the light emitting point of the light emitting device 401 regardless of the input resolution, and therefore, there is no difference in the distance between the light emitting points depending on the resolution. As described above, the present invention can be applied to the silicon substrate 402 in which the lower electrodes are arranged in at least one row.

As described above, according to Embodiment 2, the same exposure head can be used without deteriorating the image quality of both the high resolution image and the low resolution image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-152968 filed on Aug. 23, 2019, which is hereby incorporated by reference herein in its overall.

What is claimed is:

1. An exposure head comprising:

a plurality of light-emitting devices configured to expose a rotationally driven photosensitive member with light, wherein each of the plurality of light-emitting devices includes:

a first substrate, a first electrode layer including a plurality of electrodes that are (i) two-dimensionally arranged in a rotational direction of the photosensitive member and in the a direction of a rotational axis of the photosensitive member, and which (ii) are separately formed on the first substrate, a light-emitting layer laminated on the first electrode layer and configured to emit light when a voltage is applied, a light-emitting region including a second electrode layer capable of transmitting light, the light-emitting region being provided on a side of the light-emitting layer that is opposite to a side on which the first substrate and the first electrode layer are provided, the light-emitting region corresponding to the plurality of electrodes of the first electrode layer; and a second substrate on which the first substrates of the plurality of light-emitting devices are arranged at positions different from each other in an intersecting direction intersecting the rotational direction of the photosensitive member, with odd-numbered first substrates and even-numbered first substrates being at different positions in the rotational direction of the photosensitive member, and with the first substrates of the plurality of light-emitting devices being arranged so as to have overlapping portions in which respective end portions of the first substrates adjacent to each other overlap each other in the intersecting direction, wherein a driving portion including a converting portion is provided on each of the first substrates together with the light-emitting region, the converting portion being configured to convert received image data into the image data corresponding to a resolution.

2. An exposure head according to claim 1, wherein, when the resolution is a first resolution and when a latent image is to be formed on the photosensitive member at a second resolution that is lower than the first resolution, the converting portion of each of the plurality of light-emitting devices converts the received data so that two adjacent electrodes of the first electrode layer in the light-emitting region of each of the plurality of light-emitting devices have the same image data.

3. An exposure head according to claim 2, wherein the converting portion of each of the plurality of light-emitting devices includes a memory circuit group having a plurality of memory circuits configured to hold the image data for driving the plurality of electrodes in the first electrode layer, wherein the driving portion of each of the plurality of light-emitting devices includes a pulse signal generating portion group having a plurality of pulse signal generating portions configured to generate pulse signals on the basis of image data held in the memory circuit, wherein each pulse signal generating portion group generates a pulse signal based on the image data held in the memory circuit group, and wherein each memory circuit group holds the same image data in two adjacent memory circuits when the latent image is formed on the photosensitive member at the second resolution.

4. An exposure head according to claim 2, wherein each light-emitting region of the plurality of light-emitting devices includes two rows of light-emitting regions, and wherein, when the latent image is to be formed on the photosensitive member at the second resolution, each converting portion of the plurality of light-emitting devices converts the received data such that the electrodes included in two adjacent first electrode layers have the same image data, and such that the electrodes included in the two adjacent first electrode layers correspond to predetermined positions in the intersecting direction of the two rows of light-emitting regions that emit light on the basis of the same image data.

5. An exposure head according to claim 4, wherein a first pulse signal generating portion group generates a first pulse signal on the basis of the image data held in a first memory circuit group provided corresponding to the a first light-emitting region, wherein the second pulse signal generating portion group generates a second pulse signal at a different timing from the timing at which the first pulse signal is generated, on the basis of the image data held in a second memory circuit group provided corresponding to a second light-emitting region different from the first light-emitting region, and wherein, when the latent image is formed on the photosensitive member at the second resolution, the first memory circuit group and the second memory circuit group hold the same image data in two adjacent memory circuits.

6. An exposure head according to claim 1, wherein the first substrate is a silicon substrate.

7. An image forming apparatus comprising:

a photosensitive member;

an exposure head according to claim 1, the exposure head being configured to expose the photosensitive member to form an electrostatic latent image;

a developing unit configured to develop the electrostatic latent image with toner to form a toner image; and a transfer unit for transferring the toner image onto a recording sheet.

* * * * *